US012601127B2

(12) United States Patent
Zhang et al.

(10) Patent No.: US 12,601,127 B2
(45) Date of Patent: Apr. 14, 2026

(54) IMPACT DISSIPATING BOLLARD

(71) Applicant: Nano and Advanced Materials Institute Limited, Hong Kong (HK)

(72) Inventors: Kang Zhang, Hong Kong (HK); Xiyao Zhang, Hong Kong (HK); Meishan Chan, Hong Kong (HK); Shilong Zhang, Hong Kong (HK); Christopher Cheung Yec, Hong Kong (HK); Pak Chung Lau, Hong Kong (HK); Jifan Li, Hong Kong (HK); Jian Zhang, Hong Kong (HK); Jianzhuo Xin, Hong Kong (HK); Jianying Miao, Hong Kong (HK)

(73) Assignee: Nano and Advanced Materials Institute Limited, Hong Kong (HK)

( * ) Notice: Subject to any disclaimer, the term of this patent is extended or adjusted under 35 U.S.C. 154(b) by 501 days.

(21) Appl. No.: 18/448,190

(22) Filed: Aug. 11, 2023

(65) Prior Publication Data

US 2024/0003106 A1 Jan. 4, 2024

Related U.S. Application Data

(63) Continuation-in-part of application No. PCT/CN2022/076016, filed on Feb. 11, 2022.
(Continued)

(51) Int. Cl.
*E01F 15/14* (2006.01)
*E01F 15/00* (2006.01)

(52) U.S. Cl.
CPC ..... *E01F 15/146* (2013.01); *E01F 15/003* (2013.01)

(58) Field of Classification Search
CPC ..... E01F 15/003; E01F 15/146
See application file for complete search history.

(56) References Cited

U.S. PATENT DOCUMENTS 2,846,852 A 8/1958 Cappel et al.
3,946,569 A * 3/1976 Stuber ..... E02D 27/42 405/303

(Continued)

FOREIGN PATENT DOCUMENTS

AU 3505199 A * 12/2000
AU 3583299 A 1/2001

(Continued)

OTHER PUBLICATIONS

1st Office Action of the corresponding China patent application No. 202280014747.5 mailed on Jun. 20, 2025.

(Continued)

*Primary Examiner* — Gary S Hartmann
(74) *Attorney, Agent, or Firm* — IDEA Intellectual Limited; Sam T. Yip

(57) ABSTRACT

An impact dissipating bollard system includes a vertical stanchion and a composite energy-absorbing deformable cartridge configured to be positioned within a retaining foundation that includes a rigid core portion including a stanchion-receiving aperture and first and second projections extending from the rigid core portion. The first and second projections, together with the core portion, form the dumbbell shape. Energy-absorbing resilient elastic material surrounds the rigid core portion and is positioned within recesses within the first and second projections. The bollard system is configured such that impact energy is transferred from the vertical stanchion to deform the composite energy-absorbing deformable cartridge. The bollard system retaining foundation includes a reinforcing frame embedded in concrete and having a strength of least 30 MPa.

17 Claims, 40 Drawing Sheets

Related U.S. Application Data

(60) Provisional application No. 63/148,390, filed on Feb. 11, 2021.

(56) References Cited

U.S. PATENT DOCUMENTS

| | | | | |
|---|---|---|---|---|
| 7,052,201 | B2 * | 5/2006 | Zivkovic | E01F 9/685 404/11 |
| 7,901,156 | B2 | 3/2011 | McCue et al. | |
| 2004/0265055 | A1 | 12/2004 | Zivkovic | |
| 2014/0154007 | A1 | 6/2014 | Ustach et al. | |

FOREIGN PATENT DOCUMENTS

| | | | | |
|---|---|---|---|---|
| AU | 7144900 | A | 5/2001 | |
| AU | 7146300 | A | 5/2001 | |
| AU | 2014100393 | A4 | 5/2014 | |
| CH | 535331 | A | 3/1973 | |
| CH | 595511 | A5 | 2/1978 | |
| CH | 618488 | A5 | 7/1980 | |
| CN | 103031817 | A | 4/2013 | |
| CN | 203307773 | U | 11/2013 | |
| CN | 206308646 | U | 7/2017 | |
| CN | 210597123 | U | 5/2020 | |
| CN | 111560889 | A | 8/2020 | |
| CN | 211690090 | U | 10/2020 | |
| DE | 1658660 | A1 | 11/1970 | |
| DE | 19838094 | A1 | 12/1999 | |
| EP | 3865626 | B1 * | 3/2024 | E01F 13/046 |
| FR | 2125686 | A5 | 9/1972 | |
| FR | 2633954 | A1 | 1/1990 | |
| GB | 2512623 | A | 10/2014 | |
| KR | 20120084469 | A | 7/2012 | |
| KR | 101400627 | B1 * | 5/2014 | |
| WO | 2020082132 | A1 | 4/2020 | |
| WO | 2020186292 | A1 | 9/2020 | |

OTHER PUBLICATIONS

International Search Report and Written Opinion of the corresponding PCT application No. PCT/CN2022/076016 mailed on May 7, 2022.

* cited by examiner

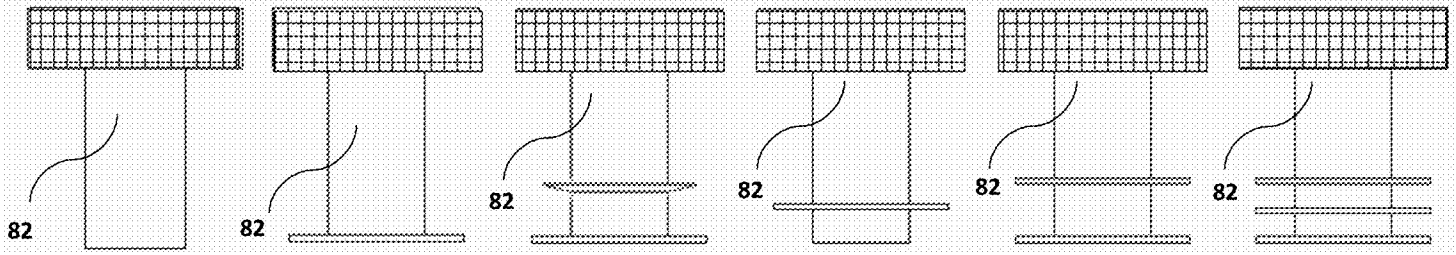
FIG. 26A
FIG. 26B
FIG. 26C
FIG. 26D
FIG. 26E
FIG. 26F
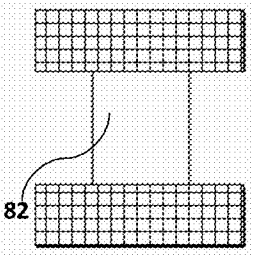
FIG. 26G
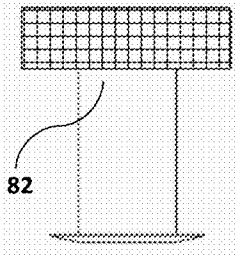
FIG. 26H
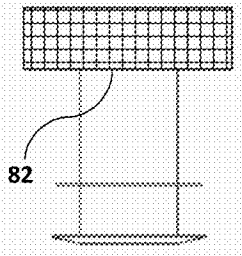
FIG. 26I
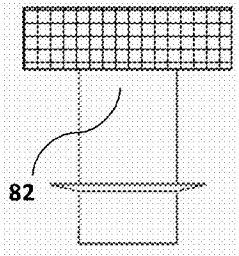
FIG. 26J
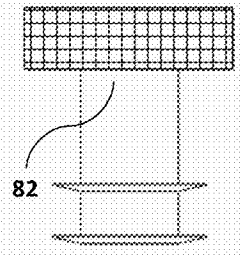
FIG. 26K
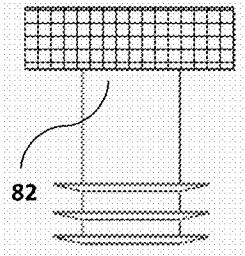
FIG. 26L

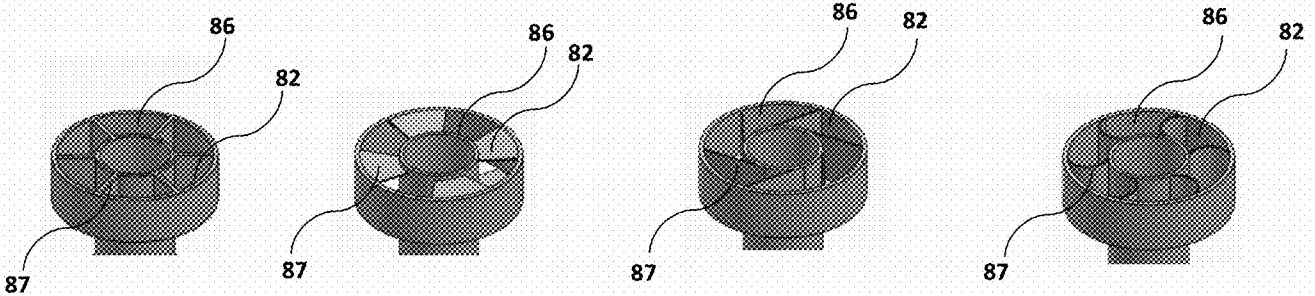
FIG. 27A
FIG. 27B
FIG. 27C
FIG. 27D
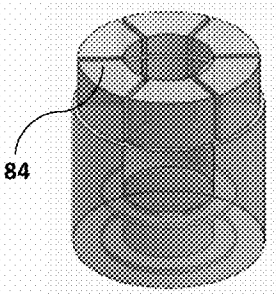
FIG. 28A
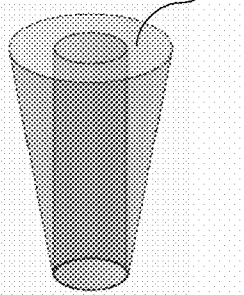
FIG. 28B
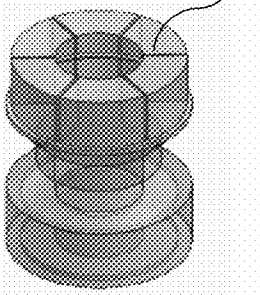
FIG. 28C
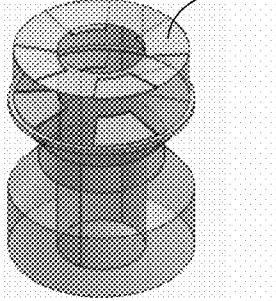
FIG. 28D

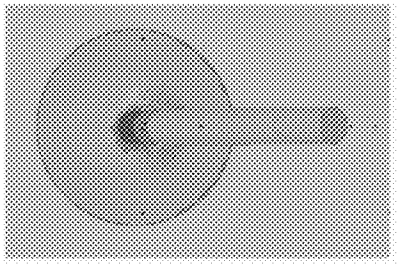
FIG. 32A
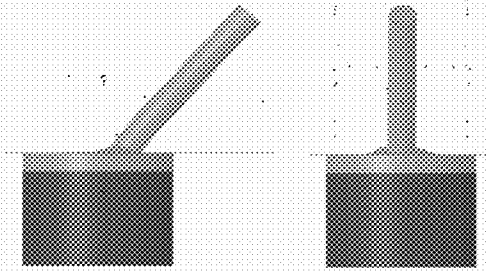
FIG. 32B
FIG. 32C
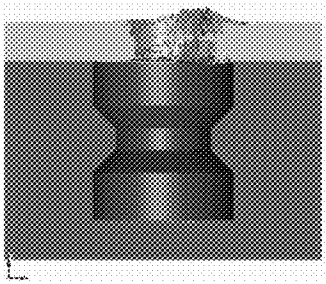
FIG. 32D
FIG. 32E
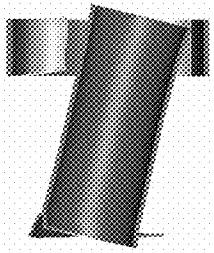
FIG. 32F
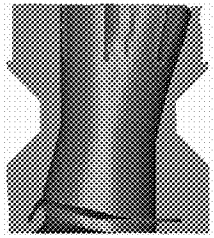
FIG. 32G

IMPACT DISSIPATING BOLLARD

CROSS-REFERENCE TO RELATED APPLICATIONS

This application is a continuation-in-part of international application PCT/CN2022/076016 filed 11 Feb. 2022, which claims priority to U.S. Provisional Patent Application 63/148390, filed 11 Feb. 2021, the disclosures of which are incorporated by reference herein.

FIELD OF THE INVENTION

The present invention relates to impact dissipating bollards (IDB), and, more particularly to impact dissipating bollards having a shallow underground profile such that the bollards may be used in dense urban areas with high densities of underground utilities.

BACKGROUND

Bollards are commonly designed as barriers for road safety that are required in certain locations such as along highways near dense pedestrian regions for instance bus stops and along pavements near schools and public buildings. Existing bollard systems are typically designed to extend underground as deep as possible for enhanced impact resistance and stability. In dense urban areas, bollards with deep foundations cannot be used due to the presence of extensive underground utilities, such as power lines, optical cables, and water pipes. However, when a bollard foundation depth is reduced, the bollard safety performance is greatly diminished for conventional designs.

Traditional bollards rely on their massive size or large foundation depth to protect pedestrians in the event of a vehicle impact. Many are high strength steel tubes or concrete pillars buried in a deep cement foundation, optionally mounted to an integrated steel platform. This rigid design means that vehicle impact energy is consumed by vehicle deformation rather than by deformation of the bollard. This vehicle deformation can endanger drivers and passengers and, at times, nearby pedestrians.

Some bollards that have been designed to absorb impact energy from a vehicle crash through bollard deformation. U.S. Pat. No. 7,901,156 describes a plate-mounted bollard which includes an internal impact absorption mechanism that enables the bollard to absorb impact forces greater than conventional plate-mounted bollards. The bollard makes use of a force transfer process that shifts impact forces to including a core rod to resiliently absorb the impact. U.S. 2014/0154007A1 also describes an impact absorption bollard which including a shock absorber positioned inside the bollard member with a fastener extending through the shock absorber and deep underground. Although the bollards described in these patents can dissipate impact energy their designs are relatively complex. This complexity will result in expensive manufacturing, installation, and maintenance; as such, these designs are not practical for areas that require large numbers of bollards such as along pedestrian walkways.

Another alternative for safety bollards is disclosed in US 2004/0265055A1. In this design, a bollard is embedded in a sand base with an annular collar which is said to provide a progressive increase in resistance to the tilting of the bollard. This bollard requires an extensive underground area, with the base of the bollard extending to a depth nearly equal to the height of the bollard. Such a bollard cannot be used in dense urban area with underground utilities. A similar commercial bollard is available in Australia which is termed "Energy Absorbing Bollards" (EAB). It is claimed that the bollard is stronger than traditional rigid iron or concrete bollard and can absorb the impact energy by utilizing a polyurethane (PU) foam around the bollard in the foundation when a vehicle hits the bollard. However, its foundation requires a depth of 1000 mm which is not practical in a dense urban area.

Thus, there is a need in the art for improved bollards that both absorb vehicle energy and may be used in regions with dense underground utilities. This invention addresses that need.

SUMMARY OF THE INVENTION

The present invention provides an impact dissipating bollard system that has a shallow base that is uniquely configured to meet the construction limitations of urban centers with substantial numbers of buried pipes and cables. Further, the bollard system includes energy absorbing structures that improve drivers and pedestrians safety.

In one aspect, the present invention provides an impact-dissipating bollard system that includes a vertical stanchion having a first portion extending above a retaining foundation and a second portion extending beneath a retaining foundation. A composite, energy-absorbing deformable cartridge is configured to be positioned within the retaining foundation. The composite, energy-absorbing deformable cartridge includes a rigid core portion with a stanchion-receiving aperture. First and second projections extend from the rigid core portion. The first and second projections, together with the core portion, form the dumbbell shape. Energy-absorbing resilient elastic material surrounds the rigid core portion and is positioned within recesses within the first and second projections. The bollard system is configured such that impact energy is transferred from the vertical stanchion to deform the composite energy-absorbing deformable cartridge. The bollard system retaining foundation includes a reinforcing frame embedded in concrete and having a strength of least 30 MPa.

In a further aspect, a frame may surround the composite energy-absorbing deformable cartridge.

In a further aspect, the energy-absorbing resilient elastic material includes foam.

In a further aspect, the vertical stanchion includes a hollow, reinforced structure.

In a further aspect, the hollow, reinforced structure includes a network of interconnected supports.

In a further aspect, the interconnected supports are interconnected hollow polygons or cylinders.

In a further aspect, the interconnected supports are interconnected polygons that may be triangles, squares, rectangles, pentagons, or hexagons.

In a further aspect, the hollow, reinforced structure includes a filler material.

In a further aspect, the filler material is selected from polymers, foams, shear-thickening fluids, carbon fiber composites, glass fiber composites or particulates reinforced composites.

In a further aspect, the vertical stanchion is made from metal, plastic, rubber, or fiber-reinforced composites.

In a further aspect, the rigid core portion of the composite energy-absorbing deformable cartridge comprises metal, polymer, fiber-reinforced composites, or ceramic.

In a further aspect, the foam may be metal foam, honeycomb metal, ethylene vinyl acetate foam, polyethylene terephthalate foam, polyvinyl chloride foam, polystyrene foam, or polyurethane foam.

In a further aspect, the foam includes a shear-thickening fluid.

In a further aspect, the shear-thickening fluid includes a hydroxyl terminated dialkylsiloxane polymer or a borate cross-linked hydroxyl terminated dialkylsiloxane polymer.

In a further aspect, the flanges are horizontally-extending flanges.

In a further aspect, the projections have an approximately circular cross-section.

In a further aspect deformable crumple zones are formed by separating walls within the projections to create internal voids for dissipating impact energy.

In a further aspect, the foam has an auxetic foam structure with a negative Poisson's ratio, such that the foam expands when stretched and hardens when compressed.

BRIEF DESCRIPTION OF THE DRAWINGS

The invention may be further understood from the following description on non-limitative examples, with reference to the accompanying drawings, in which:

FIG. 3A is a prior art configuration, 3B-3J are according to the present invention.

FIGS. 26A-26L show examples of the rigid part of the cartridge with a metal energy-absorbing structure and different bottom structures. The rigid part of the cartridge may have 0-3 bottom plates for fixing with the elastic sheath part of cartridge.

FIGS. 27A-27D show examples of different metal energy-absorbing structures of the rigid part of the cartridge.

FIGS. 28A-28D show examples of an elastic sheath portion of the cartridge having different shapes. The shapes can be in column, cone and dumbbell-shaped.

FIGS. 32A-32G show deformation of components of the impact dissipating bollard system at the end of an impact.

DETAILED DESCRIPTION OF THE INVENTION

Figure 1:
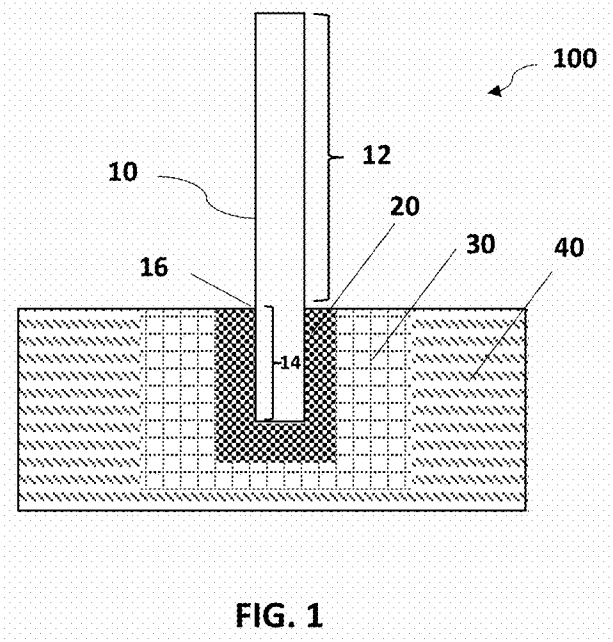
FIG. 1 is the schematic diagram of an impact dissipating bollard system according to an embodiment of the invention.

Turning to the drawings in detail, FIG. 1 schematically depicts an overview of the main components of the bollard system 100 of the present invention. The bollard system 100 includes a vertically-extending stanchion 10. As used here, the term "stanchion" relates to an upright bar, post or frame used as part of a barrier system. While the stanchion is generally vertical, it may form an angle other than a 90 degree angle with respect to its retaining foundation. The vertical stanchion 10 includes a first upper portion 12 that extends above a retaining foundation 40 and a second, lower portion 14 extending beneath a retaining foundation 40. A composite, energy-absorbing deformable cartridge 20 is positioned within the retaining foundation 40. The composite, energy-absorbing deformable cartridge includes a rigid core portion with a stanchion-receiving aperture and a plurality of flanges (not shown in FIG. 1, see, for example, FIG. 3) that surround a distal end of the vertical stanchion. As used herein, "distal end" includes the furthest tip of the stanchion 10 that is positioned within the retaining foundation and extends anywhere from this furthest tip along the stanchion, terminating at any point between the tip and a point 16 at which the stanchion emerges from the foundation.

An energy-absorbing resilient elastic sheath surrounds the rigid core portion and the plurality of flanges, both of which are discussed in further detail below in connection with FIGS. 3 and 6-25. The bollard system is configured such that impact energy is transferred from the vertical stanchion to deform the composite energy-absorbing deformable cartridge. The second portion 14 of the vertical stanchion and the composite energy-absorbing deformable cartridge form less than 35 percent of a total height of the impact-dissipating bollard system/extend fewer than 80 cm beneath the surface of a retaining foundation such that the bollard system is configured for environments with dense underground utilities.

Figure 39B:
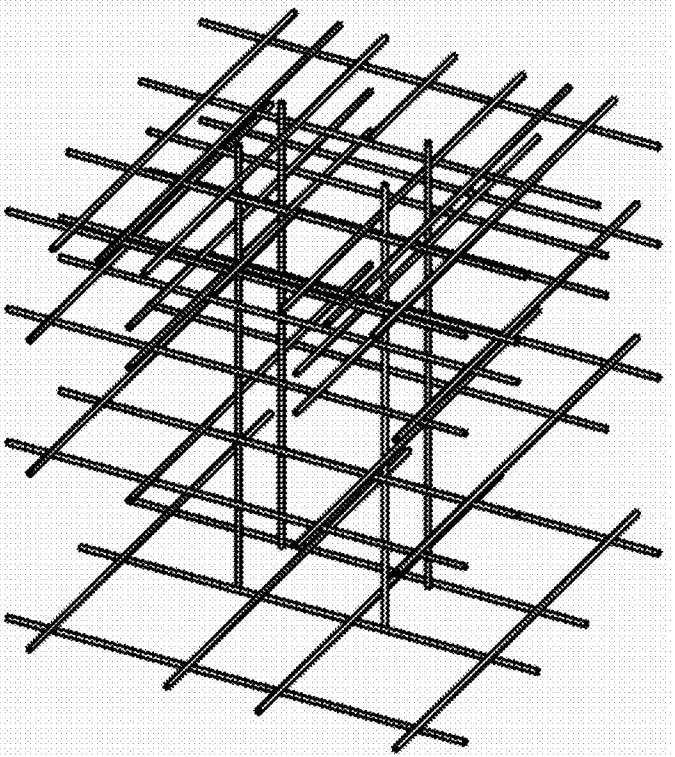
FIG. 39A-39B depicts an exemplary layout for a reinforcing cage structure to surround the cartridge of the bollard system.
Figure 39A:
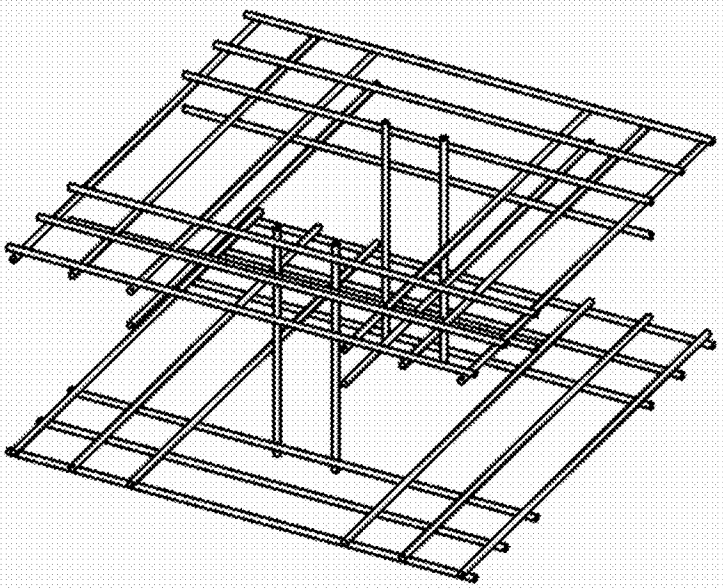

An optional reinforcing cage structure 30 surrounds the composite energy-absorbing deformable cartridge 20. The cage portion may be filled with concrete, cement, or other hardenable materials to secure the stanchion with retaining foundation 40. A more detailed view of the reinforcing cage structure is depicted in FIG. 39A-B. As will be discussed in further detail below, the reinforcing cage structure 30 may have different configurations depending upon the selected depth of the bollard system. In one embodiment, the reinforcing cage structure may be infiltrated with concrete with the bollard system embedded therein; the entire structure may then be installed on site for rapid deployment of a bollard array (that is, two or more bollards in a selected configuration to protect a particular area from incursion by vehicles.

In one aspect, a total height of the stanchion may be approximately 500 to 3000 mm with the portion 12 that extends above the retaining foundation 40 being approximately 325 to 1950 mm; in a particular embodiment this height is 500 to 1,800 mm. The length of section 14 that is embedded within the retaining foundation 40 may be approximately 400 mm to 1000 mm; in one particular aspect, it may be 100 to 800 mm. Exemplary diameters of the stanchion are 100 to 300 mm.

Vertically-extending stanchion 10 may be solid or hollow, depending upon the selected material of the stanchion and the application of the bollard system. For example, in some applications, the stanchion 10 may be solid concrete or cement, solid metal, solid plastic, solid rubber, solid fiber-reinforced polymers, or solid fiber-reinforced metals. In other applications, the stanchion 10 may be hollow, with or without reinforcing internal structures; for hollow applications, the stanchion may be made of metal, plastic, rubber, or fiber-reinforced composites.

Figure 2:
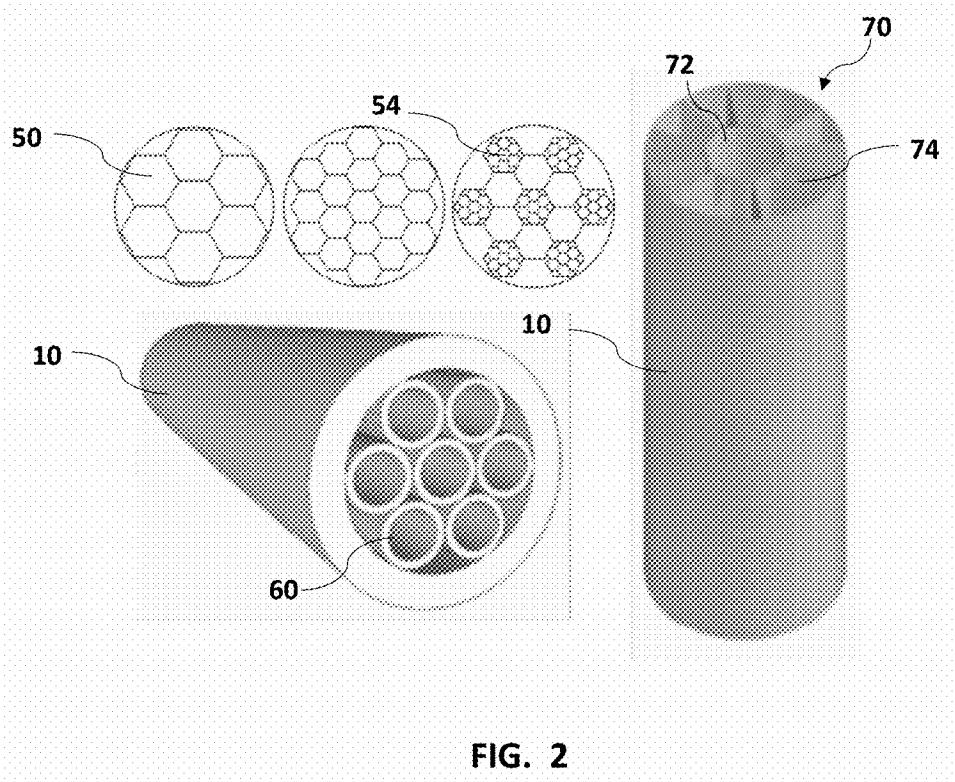
FIG. 2 shows the inner structure examples of a stanchion of the impact dissipating bollard system.

FIG. 2 depicts examples of reinforcing internal stanchion structures that may be used for hollow stanchions. As seen in FIG. 2, the reinforced structure includes a network of interconnected supports that may be interconnected hollow polygons 50, interconnected cylinders 60, or combinations thereof such as support 70 that includes a central cylinder 72 with radially-extending fins 74. Other polygonal shapes that may be uses as supports include triangles, rectangles, squares, pentagons (e.g., "honeycomb" network), hexagons, and combinations thereof such as pentagons with cylinders formed within the pentagon, 54. These structures may be symmetrical or asymmetrical and formed perpendicular to the vertical axis or at acute angle with respect to the vertical axis. Further, the supports may extend throughout the entire length of the stanchion or through only one or more portions of the stanchion. In selected embodiments, these reinforcing interconnected supports are designed to deform upon impact, forming "crumple zones" that absorb the impact energy, minimizing the damage to the vehicle that collides with the stanchion.

In further embodiments, the hollow reinforced stanchions may include a filler material to further absorb the impact energy. The filler material may be one or more polymers, foams, shear-thickening fluids, fiber reinforced composites or particulates reinforced composites. The filler may be selected to be a rigid filler, soft particles, or combinations thereof. When shear-thickening fluids are selected, they may include a hydroxyl terminated dialkylsiloxane polymer or a borate cross-linked hydroxyl terminated dialkylsiloxane polymer. The use of a filler further absorbs impact energy and minimizes vehicle damage.

Figures 3A, 3B, 3C, 3D, 3E:
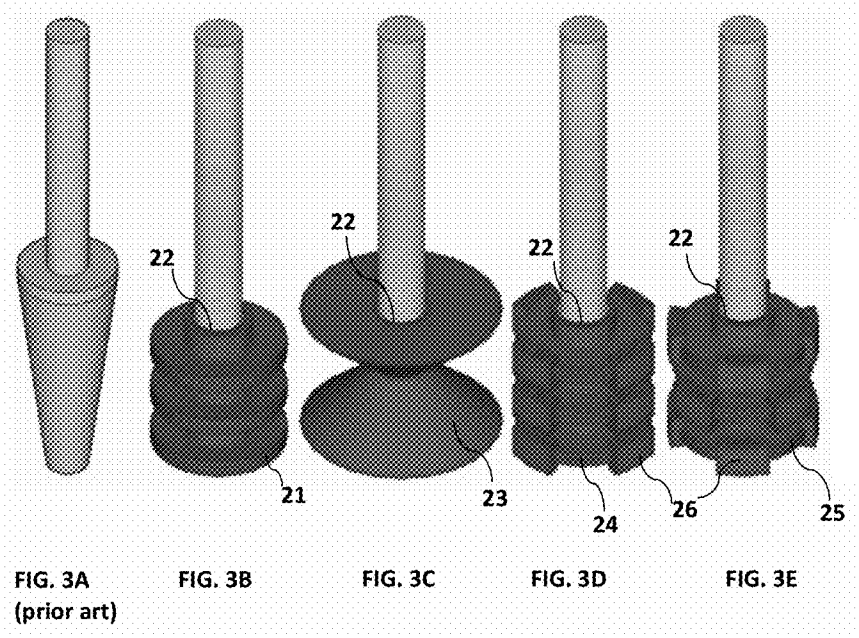
FIG. 3A (prior art)
FIGS. 3A-3J are schematic diagrams showing cartridge configurations.

FIGS. 3B-3J depict various configurations for the composite, energy-absorbing deformable cartridge 20 that is positioned at a distal end of stanchion 10. In FIG. 3B, plural horizontally-extending flanges 21 extend from a central stanchion-receiving aperture 22. In the embodiment of FIG. 3B, the horizontally-extending flanges have a plate-like circular shape; however, it is understood that the horizontally-extending flanges may have a variety of profiles includes squares, rectangles, triangles, pentagons, hexagons, etc., and may be symmetrically or asymmetrically-disposed about the central stanchion-receiving aperture 22.

In FIG. 3C, the horizontally-extending flanges 23 have an approximately conical shape while the horizontally-extending flanges 24 and 25 of FIGS. 3D and 3E have a plate-like circular shape with vertically-extending projections 26 extending from their peripheral edges. Different numbers of horizontally-extending flanges may be selected with a range of two to four flanges being a typical number.

Figures 3F, 3G, 3H, 3I:
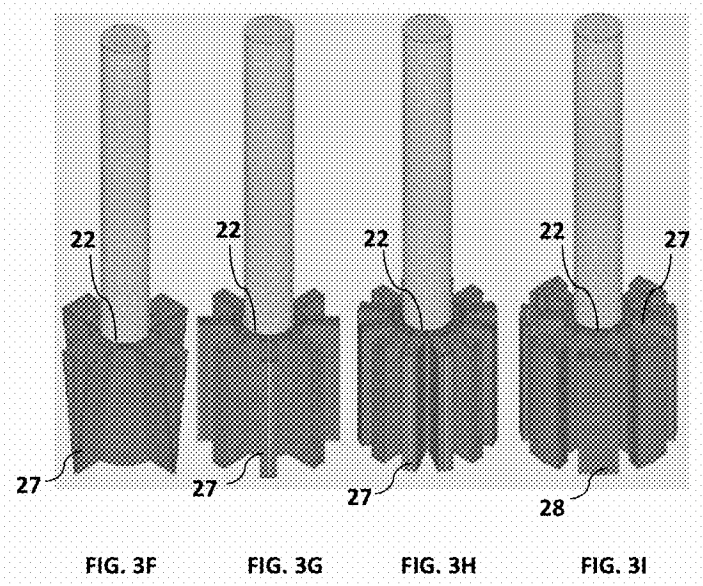
Figure 31:
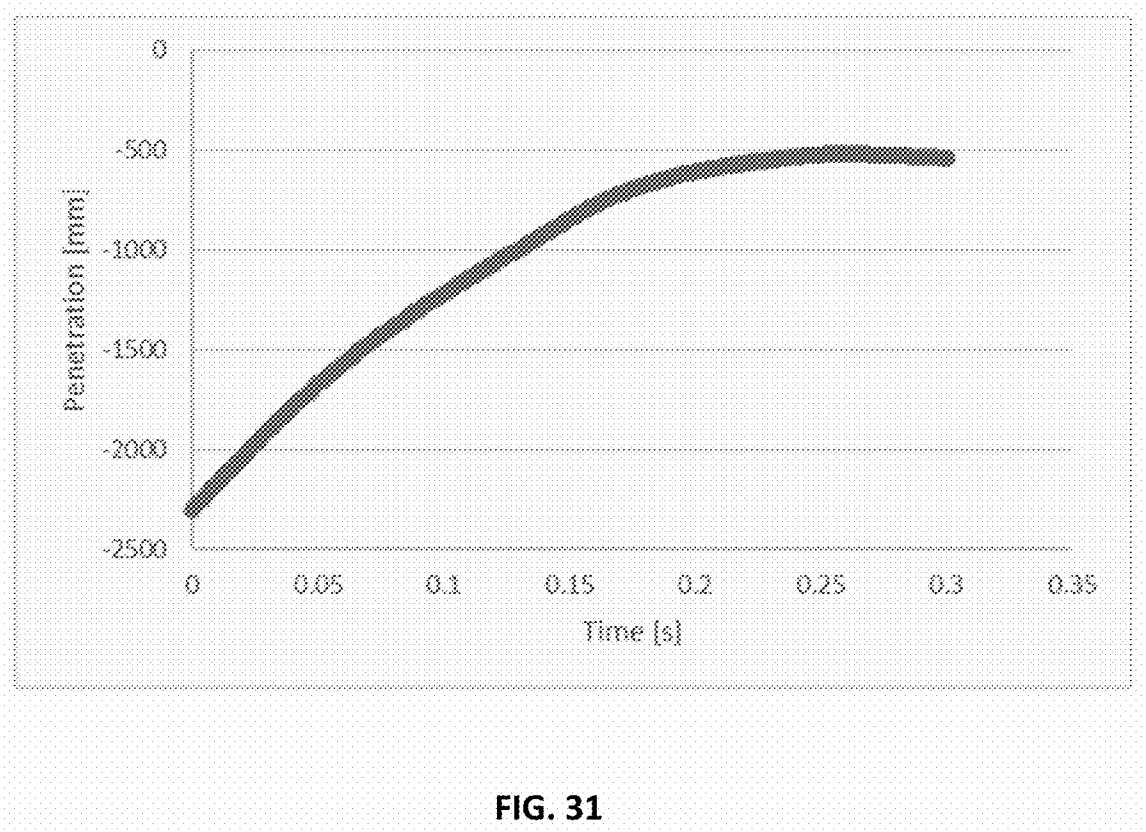
FIG. 31 shows the penetration distance of a vehicle versus time.

FIGS. 3F-3I depict vertically-extending fins 27 extending from the central stanchion-receiving aperture 22. The vertically-extending fins 27 may have a uniform cross-section as shown in FIGS. 3G and 3H or may include a taper as in FIG. 3F. Perpendicular projections 28 may extend from the terminal peripheral edge of the vertically-extending fins 27 as shown in FIG. 31. Various numbers of vertically-extending fins may be included with typical numbers ranging from 3-10 fins.

Figure 3J:
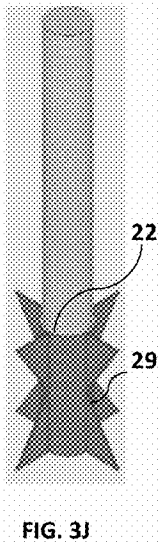

FIG. 3J shows a further alternative structure for the composite, energy-absorbing deformable cartridge 20. A series of triangular projections 29 extend from the central stanchion-receiving aperture 22. Other regular or irregular shapes may extend from the central aperture as in the embodiment of FIG. 3J.

Figure 4:
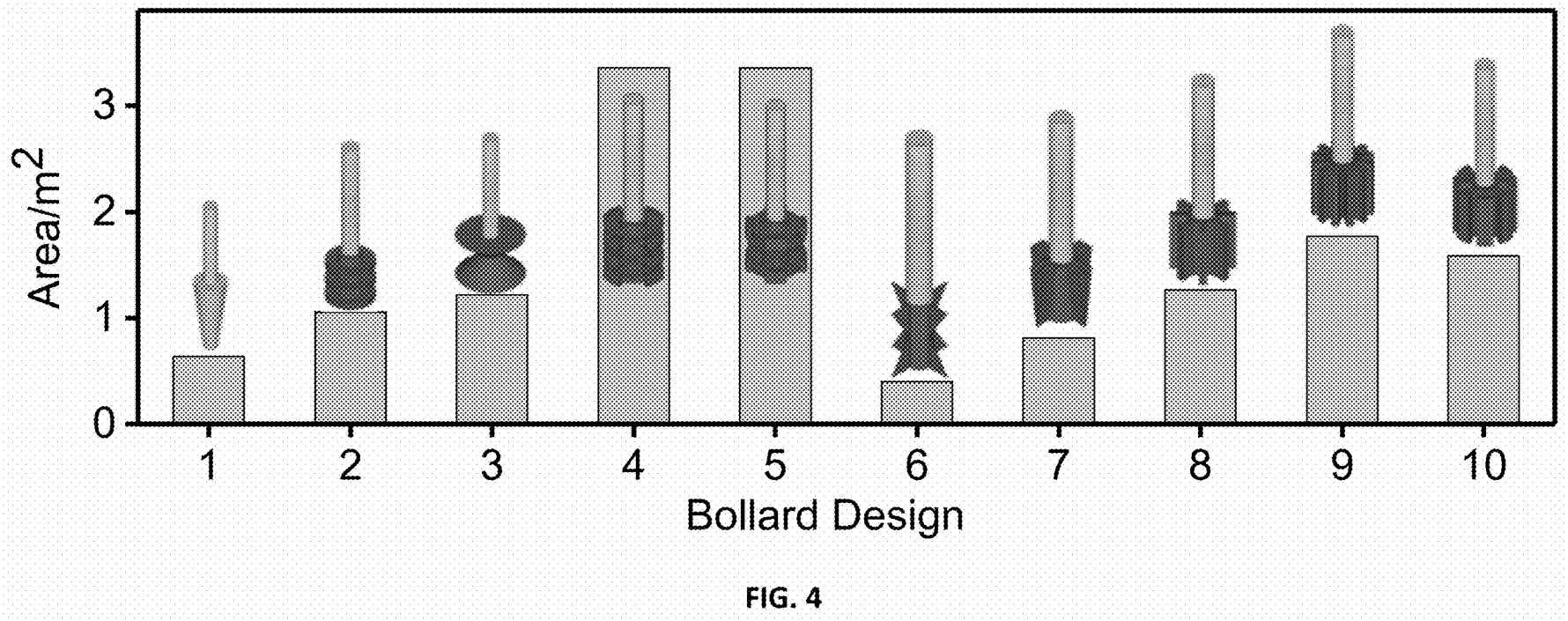
FIG. 4 is a plot of the surface area of each cartridge within the retaining foundation, at the same diameter and height.
Figure 5:
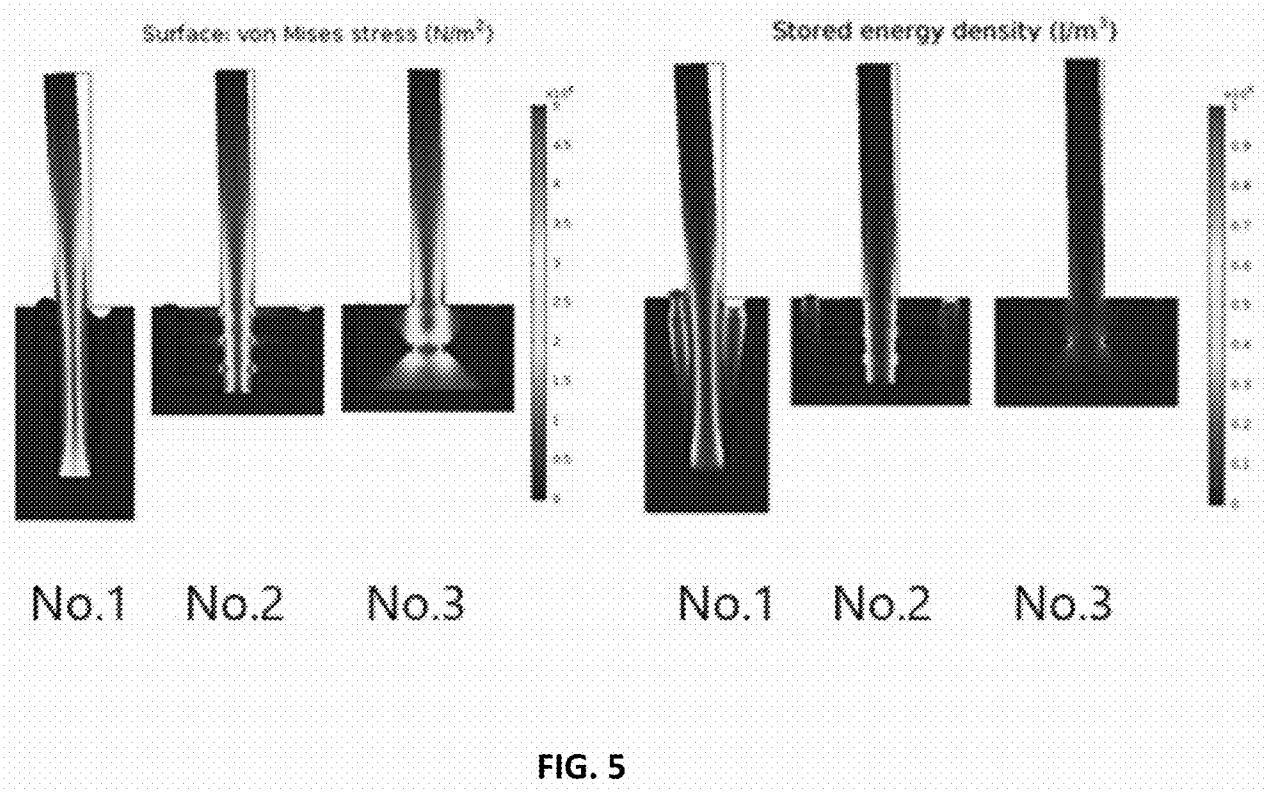
FIG. 5 shows stress distribution and stored energy density distribution for different cartridge configurations compared to the prior art.
Figure 6D:
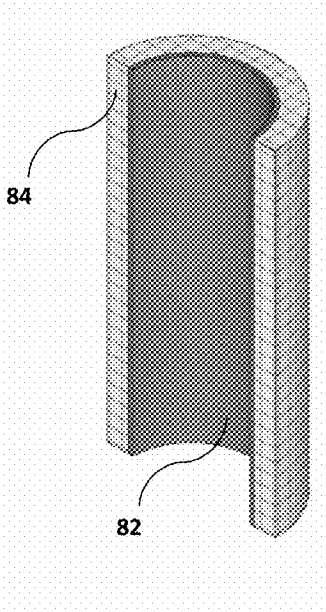
FIGS. 6A-6D schematically depict a cartridge without fins or flanges to illustrate the rigid core portion and elastic sheath portion.
Figure 6C:
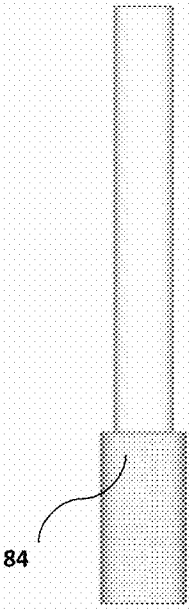
Figure 6B:
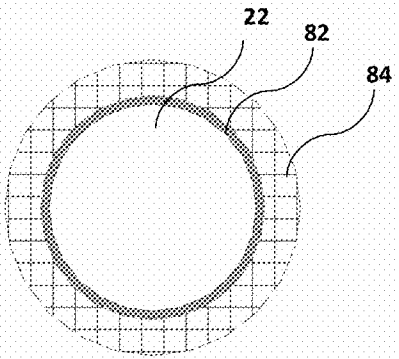
Figure 6A:
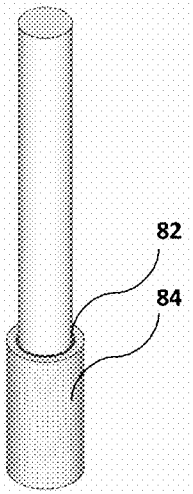

Using flanges, fins, or other structures, the contact area between the cartridge 20 and the retaining foundation 40 is increased. As a result, there is a decreased risk of the bollard system being forced from its retaining foundation during an impact. FIG. 4 depicts the increased contact area based on the selected flange or fin structure as compared to a prior art structure. The cartridge configurations of FIGS. 3B-3I all exhibit increased contact area as compared to the prior art for several cartridge configurations.

Figure 36:
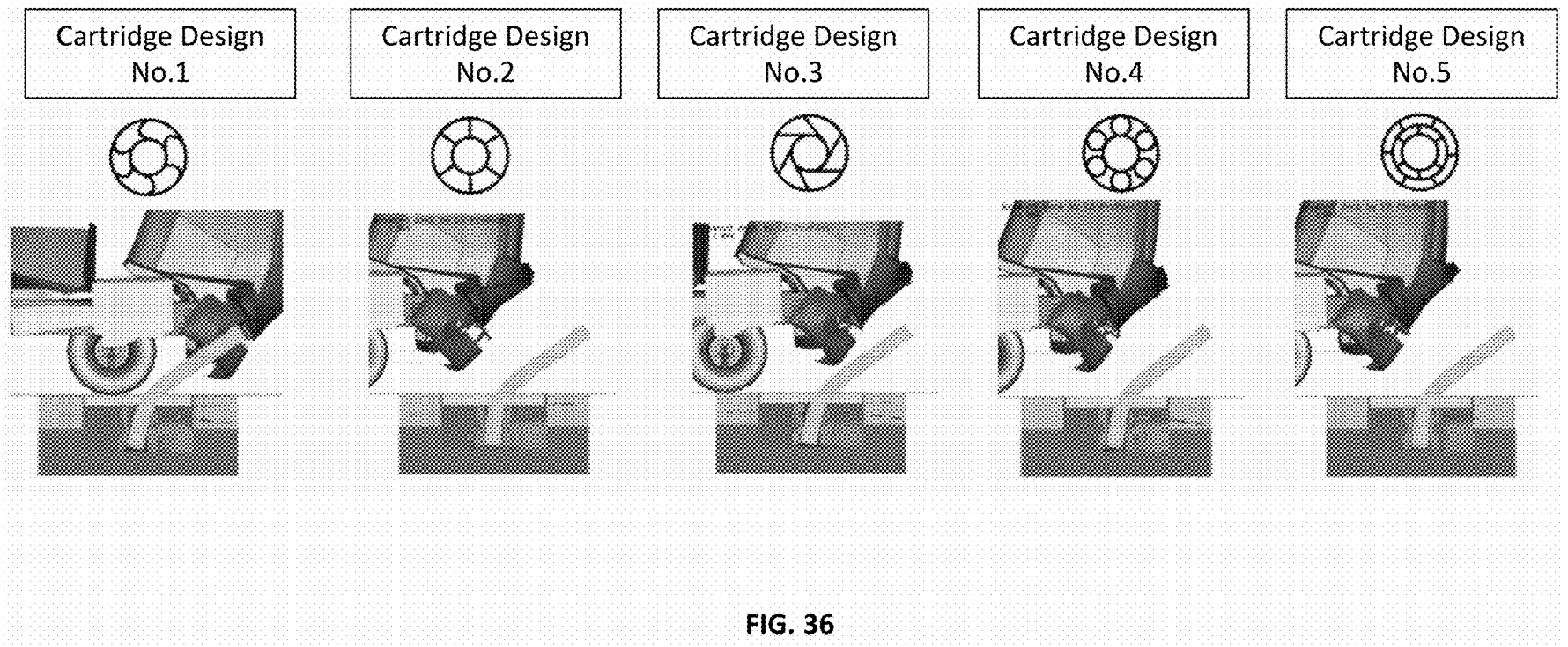
FIG. 36 shows the effects of cartridge crumple zone design.

In a particular embodiment, the composite energy-absorbing deformable cartridge may be dumbbell-shaped or hourglass-shaped. As used herein, the term "dumbbell-shaped" refers to a shape having a bar or post shape with projections at either end of the bar or post, similar to dumbbell weights. An hourglass shape approximates that of an hourglass which similarly includes projections at either end of a bar/post but includes tapering from the projections towards the bar/post central structure. As seen in the present invention, in FIGS. 29B and 29E, there are projections/flanges 21 with rigid energy-absorbing portions. The energy-absorbing portions includes voids 86 (FIG. 29C) that form crumple zones that deform to absorb the energy of an impact. Other void structures and partitions within the projections are depicted in FIG. 36 which will be discussed in further detail in the Examples, below.

Figures 29A, 29B, 29C, 29D, 29E:
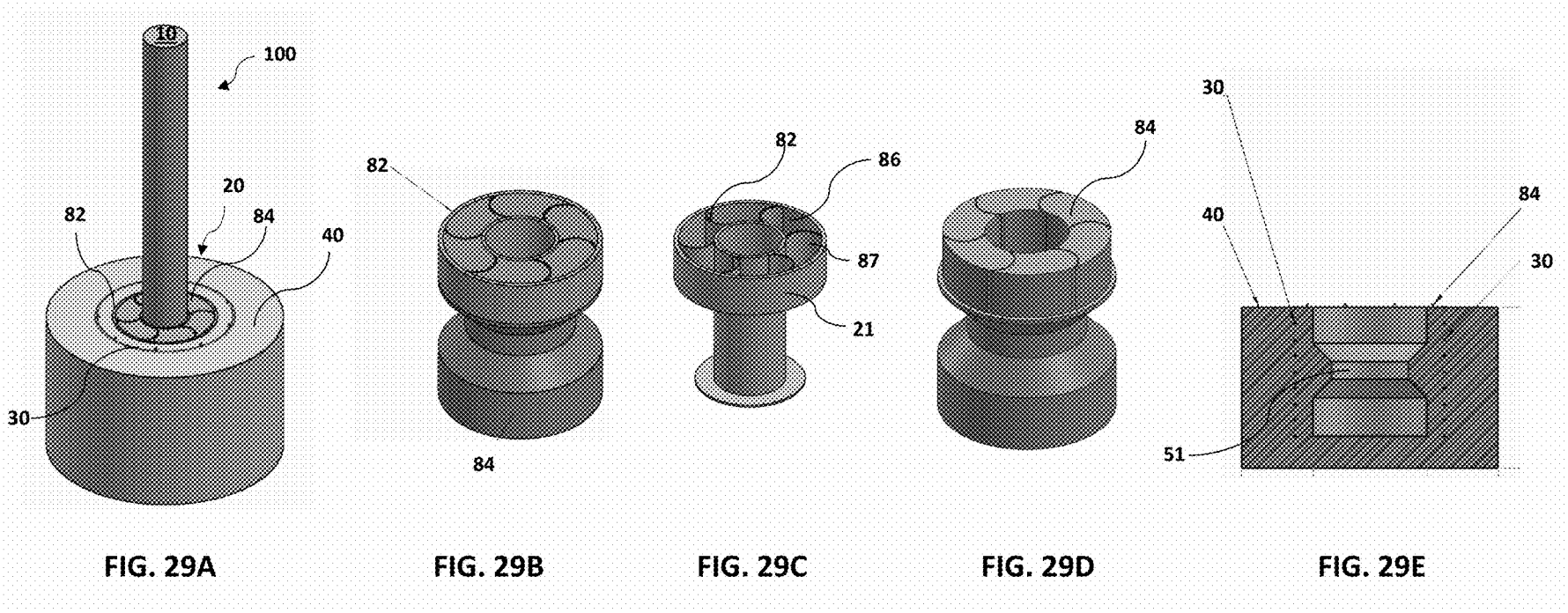
FIGS. 29A-29E show an example of an impact dissipating bollard system.

The composite energy-absorbing deformable cartridge 20 includes a rigid core portion and an energy-absorbing resilient elastic sheath surrounding the rigid core portion and the plurality of flanges or fins. FIGS. 6A-6D schematically depicts the structure of the core-sheath configuration of the present invention for the central stanchion-receiving aperture 22. In FIGS. 6A-6D, element 82 is the rigid core portion which made be made of metal, ceramics, rigid polymer, fiber-filled polymer, or fiber filled metal. The elastic sheath 84 surrounds the rigid core portion 82 and is fixed by the rigid core portion. Although a conformal elastic sheath 84 is depicted in FIGS. 6A-6D, the elastic sheath may take on a variety of shapes to increase the contact area with the retaining foundation. Exemplary non-conformal shapes are depicted in FIGS. 28A-28D, and include a columnar shape (FIG. 28A), a cone shape (FIG. 28B), and dumb-bell shaped foams (FIGS. 28C, FIG. 28D, 29D, and 29E). Depending upon the shape of energy-absorbing resilient elastic material that surrounds the rigid core portion the overall shape of the cartridge may approximate that of an hourglass in that outer periphery of the cartridge gradually decreases from the projections towards the bar/post shape 51 between the projections (FIG. 29E). In this manner impact energy is transferred from the vertical stanchion to deform the composite energy-absorbing deformable cartridge during a collision with a moving vehicle.

In general, the resilient elastic sheath is configured to absorb kinetic energy of a vehicle as a buffer through the deformation of the cartridge upon vehicle impact, reducing damage to the vehicle and minimizing occupant injury. The elastic sheath 84 may be a polymer or a rubber material. In one aspect, the polymer or rubber may be a polymer or rubber foam. Any foam may be selected including, but not limited to, ethylene vinyl acetate (EVA), polyethylene terephthalate (PET), polyvinyl chloride (PVC), polystyrene (PS) or polyurethane (PU). Alternatively, metal foams and honeycombs may be used such as aluminum, titanium, nickel, alloys including these materials. Non-metallic foams such as carbon foam may also be used.

When a foam is selected, the foam may be applied to the rigid core portion through either a physical or chemical process. For a physical method to produce sheath 84, expandable beads or gaseous introducing using nitrogen, carbon dioxide, pentane, hexane, or other gases may be used. For chemical method to produce sheath 84, carbon dioxide or nitrogen is generated in-situ from precursor chemicals, such as isocyanates or azo foaming agents. Additionally, surfactants, such as polydimethylsiloxane-polyoxyalkylene block copolymers, silicone oils, or nonylphenol ethoxylates, may be added. These surfactants emulsify the liquid components, regulate cell size, and stabilize the cell structure to prevent collapse and subsurface voids. Other additives, such as UV-stabilizers, bacteriostats, flame retardants, pigments, and other fillers, may also be used, based on the final location and application of the bollard system. In certain embodiments, additives of non-Newtonian materials, such as a shear-thickening fluid or dilatant such as hydroxyl terminated dialkylsiloxane polymer and borate cross-linked hydroxyl terminated dialkylsiloxane polymer, may be used to enhance the energy dissipation capability of the bollard system.

The resilient sheath 84 may be fabricated using a hot press or via injection molding to create the desired density, morphology, and mechanical properties. For example, a single bollard system of the present invention used at a garage entrance for ingress/egress is more likely to receive repeated impacts and thus the bollard system needs to be able to dissipate a greater amount of energy. In contrast, a series of bollards along a pedestrian pavement is less likely to receive repeated impacts and a lower-energy-dissipating bollard system may be employed.

Figures 7A, 7B, 7C, 7D:
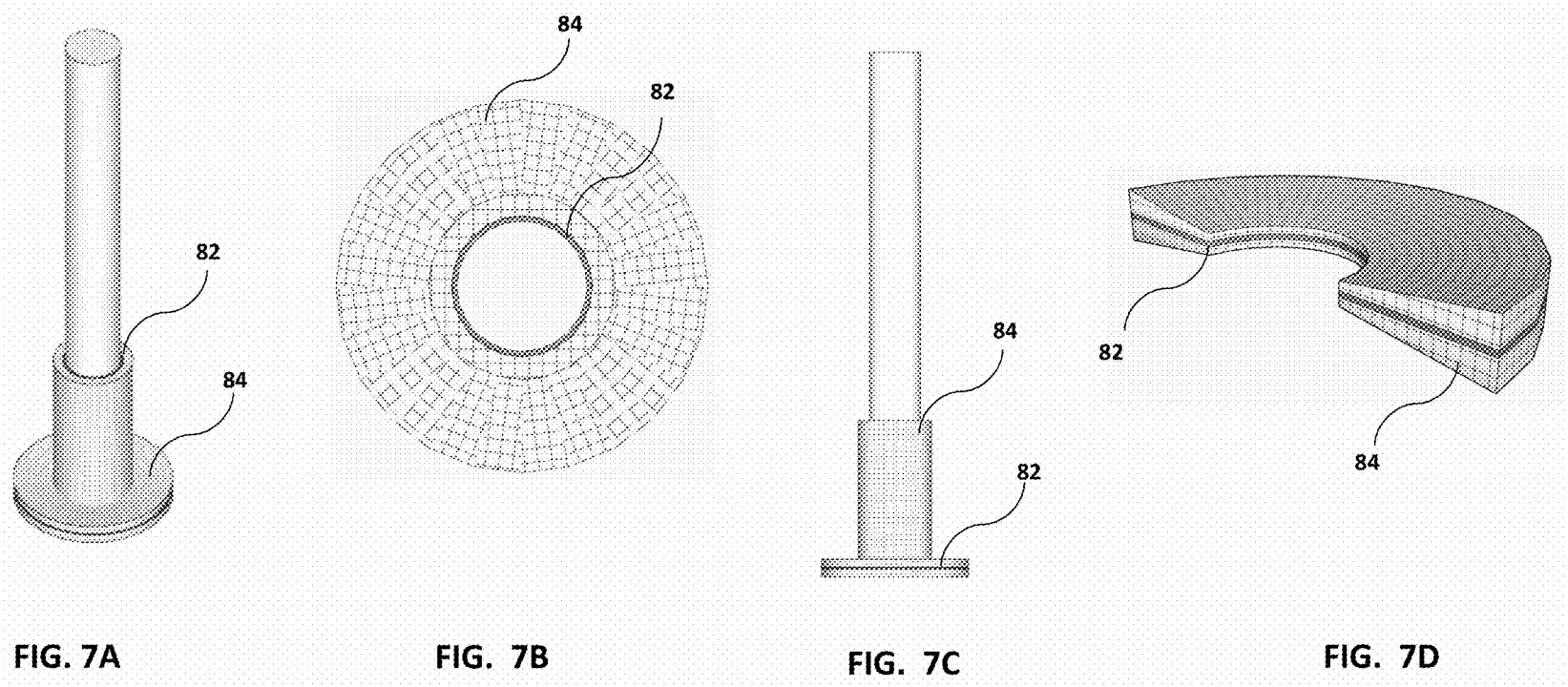
FIGS. 7A-7D shows example of a cartridge with one horizontal fin at the bottom of the cartridge (7A) schematic (7B) top-view schematic (7C) lateral-view schematic (7D) cross section-view schematic.
Figures 8A, 8B, 8C:
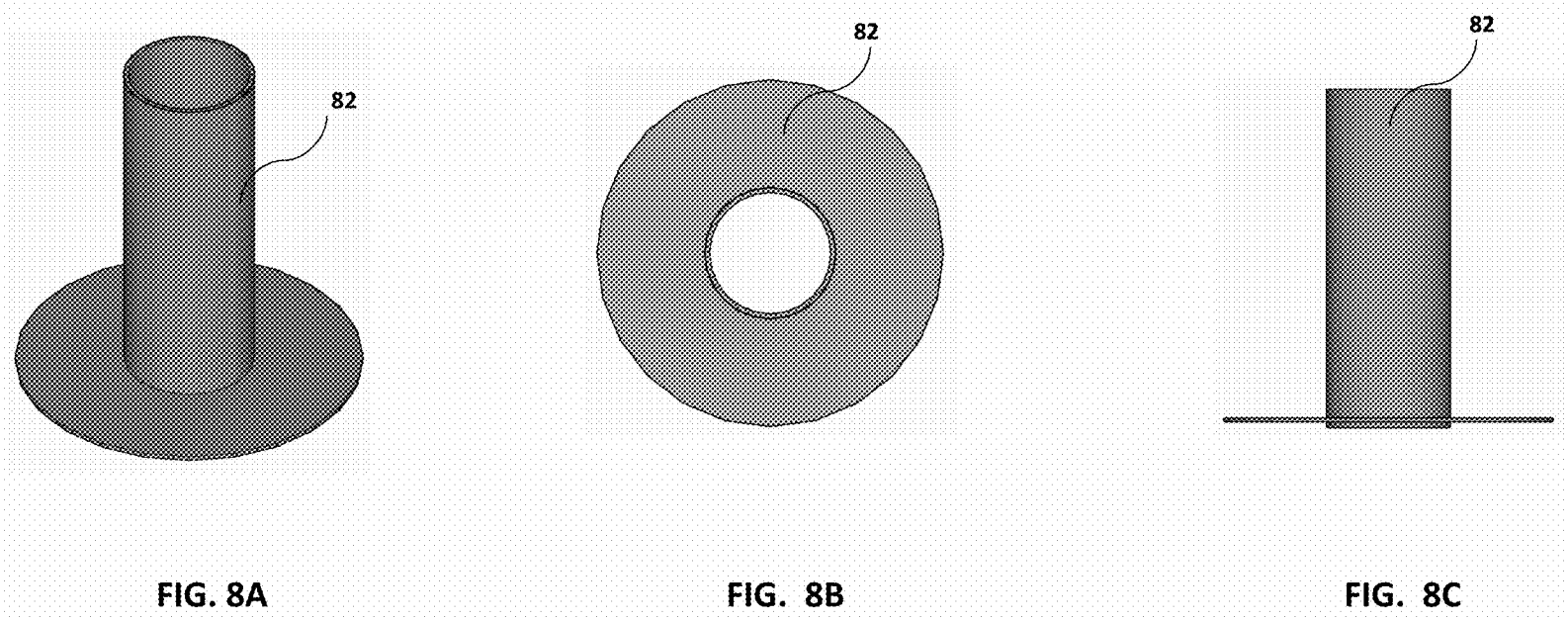
FIGS. 8A-8C shows an example of rigid portions of the cartridge of FIG. 7. The rigid part of the cartridge has same structure (shape and alignment) as that of the polymer part of cartridge. (8A) schematic (8B) top-view schematic (8C) side-view schematic.
Figure 9C:
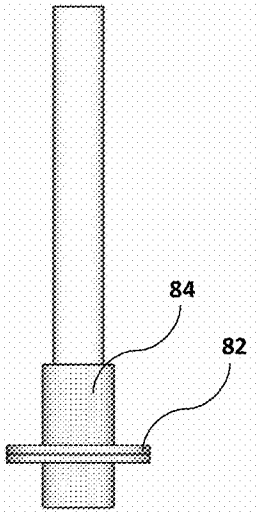
FIGS. 9A-9C shows a cartridge example with one horizontal flange at the middle of the cartridge (9A) schematic (9B) top-view schematic (9C) side-view schematic.
Figure 9B:
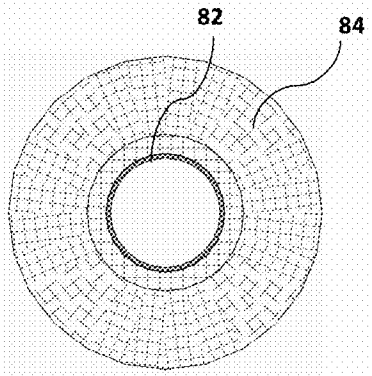
Figure 9A:
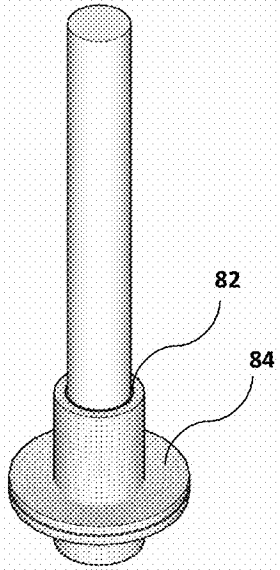
Figures 10A, 10B:
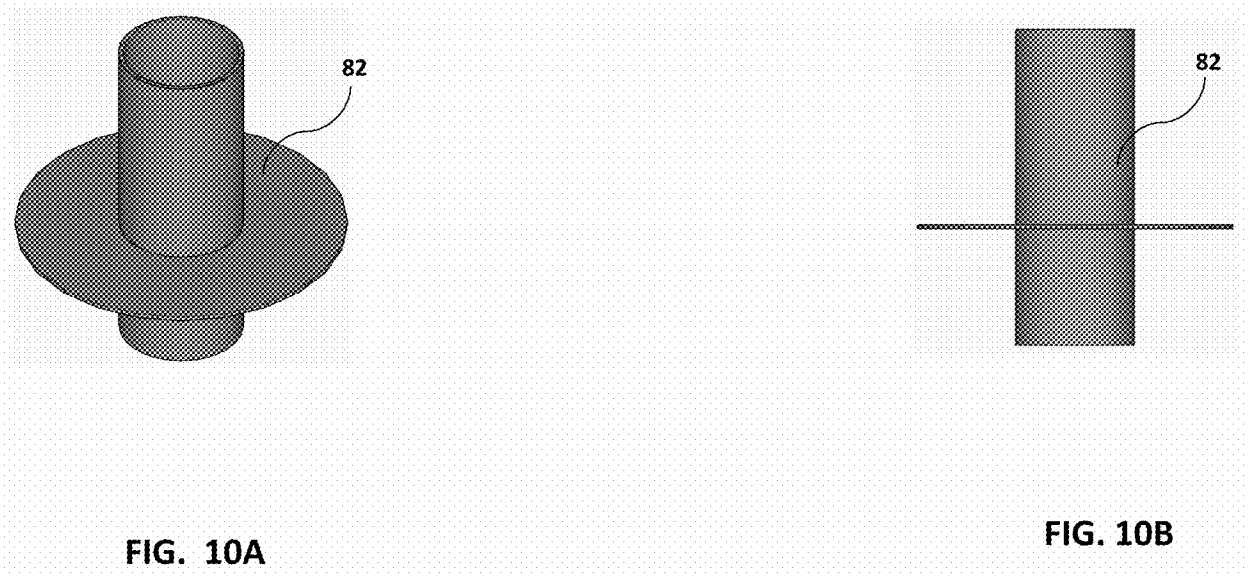
FIGS. 10A-10B shows example of rigid part of the cartridge of FIG. 9. The rigid part of the cartridge has same structure (shape and alignment) as that of the polymer part of cartridge. (10A) schematic (10B) side-view schematic
Figure 11C:
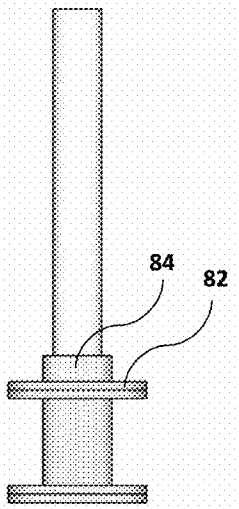
FIGS. 11A-11C shows a cartridge with two horizontal flanges on the cartridge (11A) schematic (11B) top-view schematic (11C) side-view schematic.
Figure 11B:
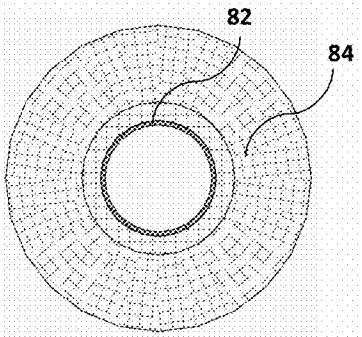
Figure 11A:
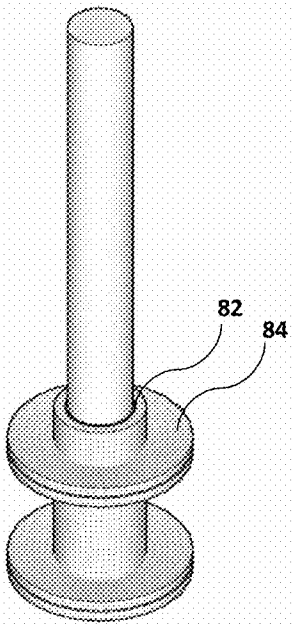
Figures 12A, 12B, 12C:
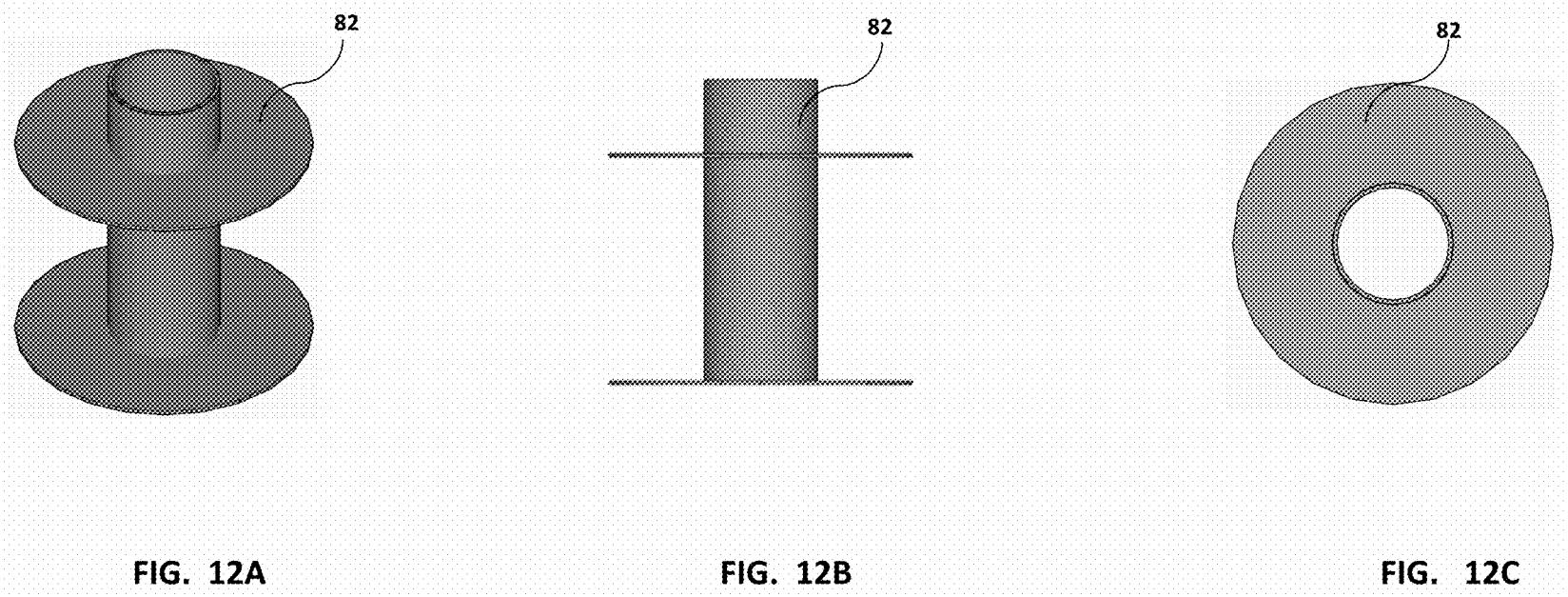
FIGS. 12A-12C show an example of the rigid part of the cartridge of FIG. 11A-11C. The rigid part of the cartridge has same structure (shape and alignment) as that of the polymer part of cartridge. (12A) schematic (12B) side-view schematic (12C) top-view schematic
Figure 13C:
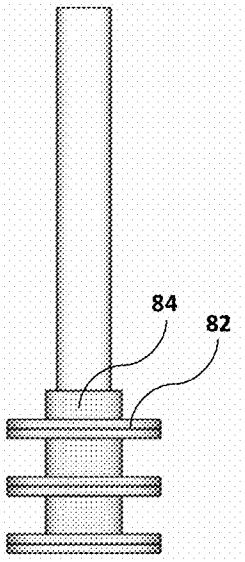
FIGS. 13A-13C show an example of a cartridge with three horizontal flanges. (13A) schematic (13B) top-view schematic (13C) side-view schematic.
Figure 13B:
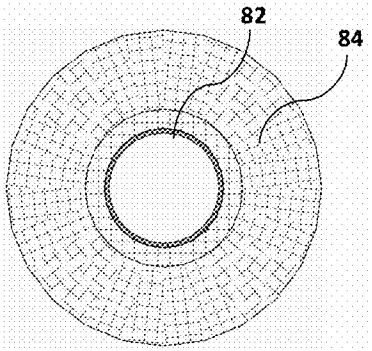
Figure 13A:
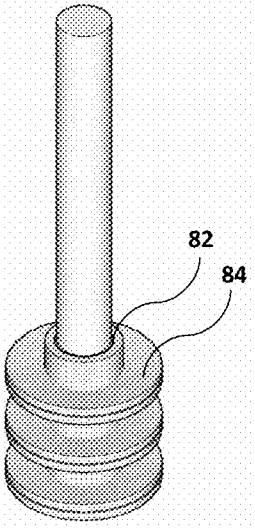
Figures 14A, 14B, 14C:
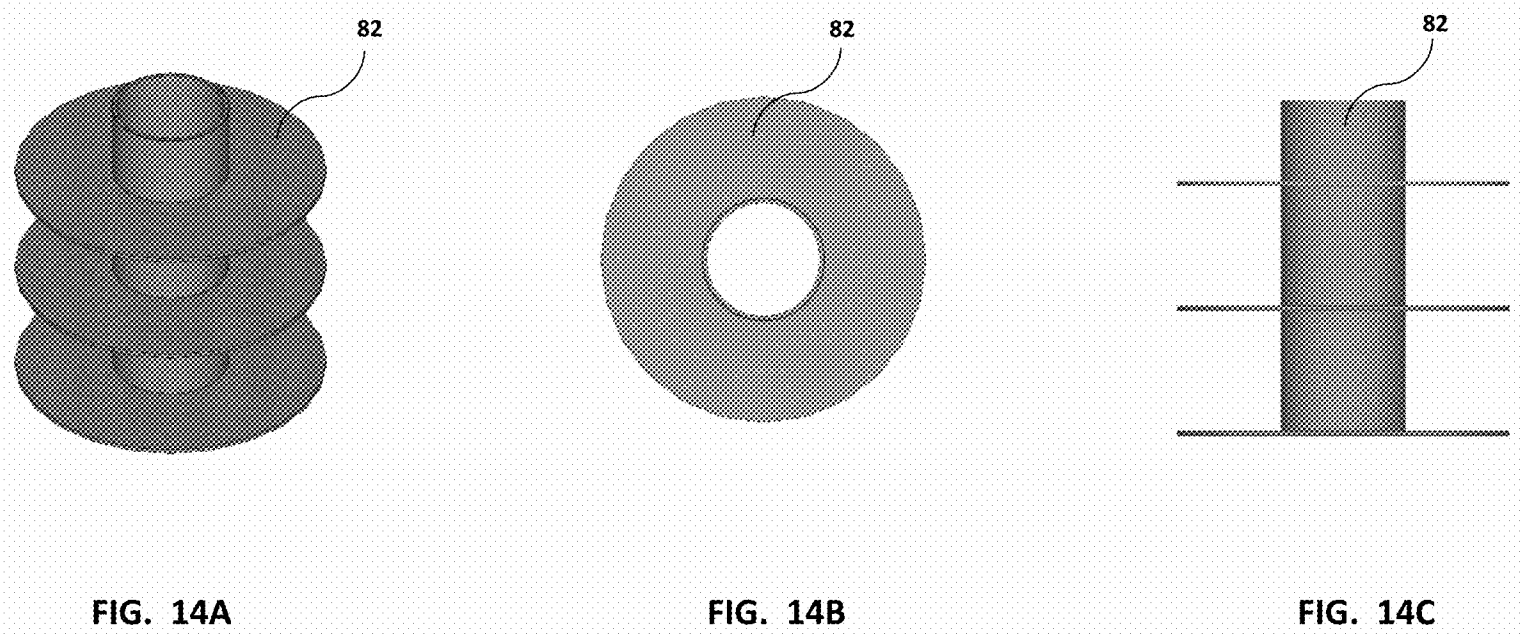
FIGS. 14A-14C show an example of a rigid part of the cartridge of FIGS. 13A-13C. The rigid part of the cartridge has same structure (shape and alignment) as that of the polymer part of cartridge. (14A) schematic (14B) top-view schematic (14C) side-view schematic.
Figure 15C:
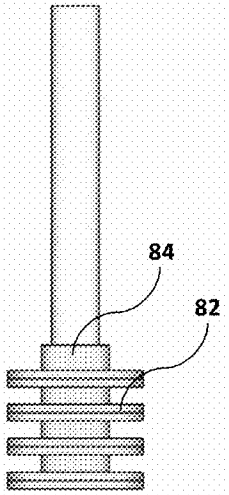
FIGS. 15A-15C show an example of a cartridge with four horizontal flanges. (15A) schematic (15B) top-view schematic (15C) side-view schematic.
Figure 15B:
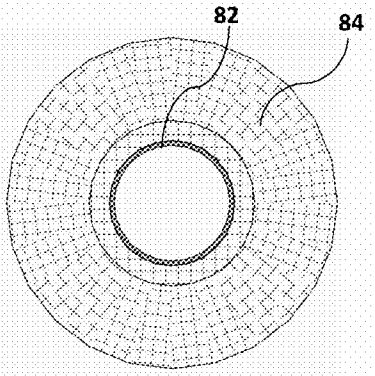
Figure 15A:
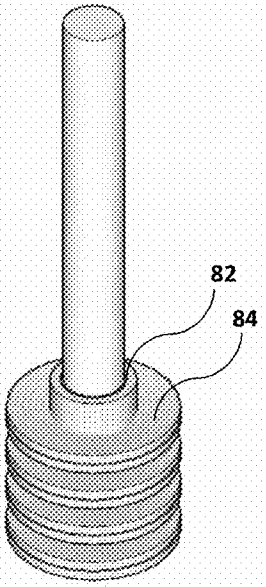
Figure 16B:
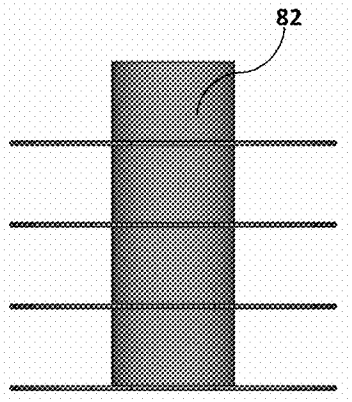
FIGS. 16A-16B show an example of rigid part of the cartridge FIGS. 15A-15C. The rigid part of the cartridge has same structure (shape and alignment) as that of the polymer part of cartridge. (16A) schematic (16B) side-view schematic.
Figure 16A:
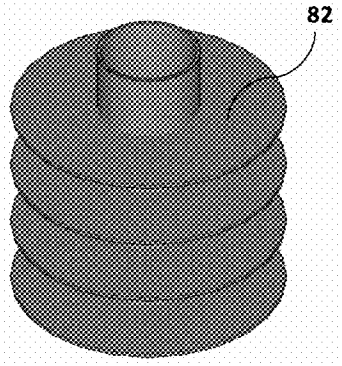
Figure 17C:
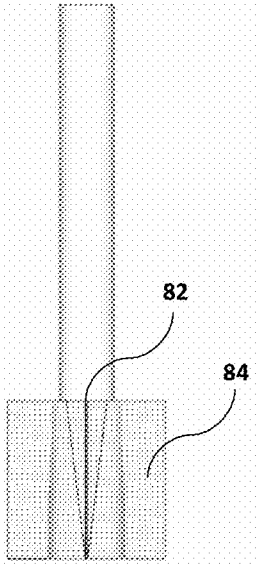
FIGS. 17A-17C show an example of a cartridge with four vertical fins (non-uniform dimension with one side large and the other small). (17A) schematic (17B) top-view schematic (17C) side-view schematic.
Figure 17B:
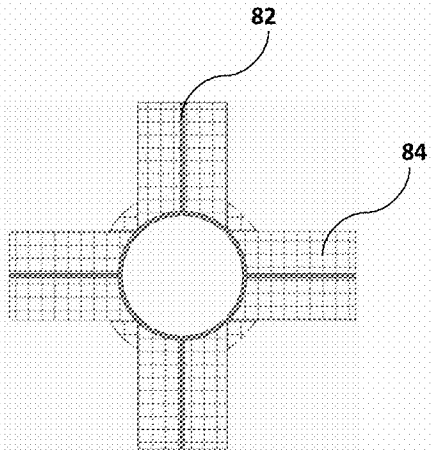
Figure 17A:
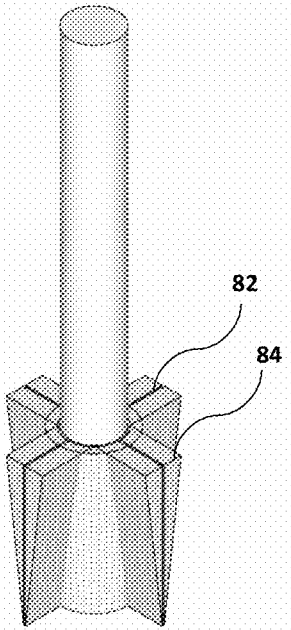
Figure 18B:
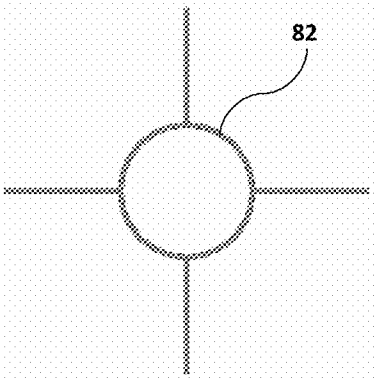
FIGS. 18A-18B show an example of rigid part of the cartridge FIGS. 17A-17C. (18A) schematic (18B) side-view schematic.
Figure 18A:
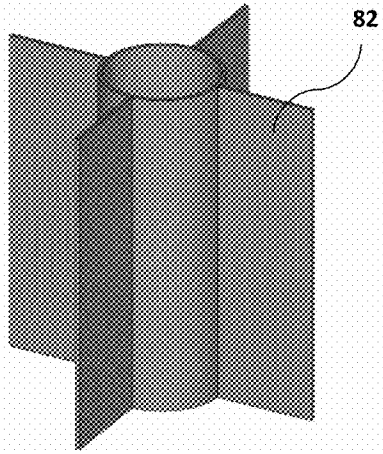
Figures 19A, 19B, 19C:
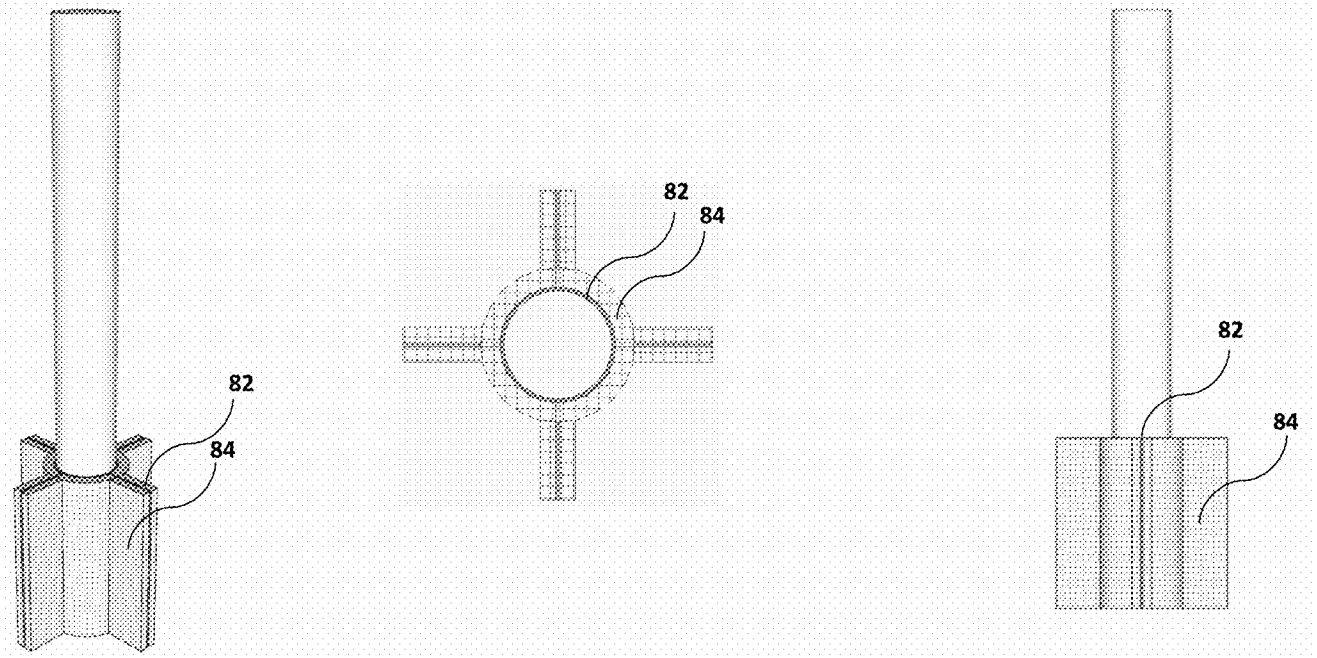
FIGS. 19A-19C show an example of a cartridge with four vertical fins (uniform dimension). (19A) schematic (19B) top-view schematic (19C) side-view schematic
Figure 20C:
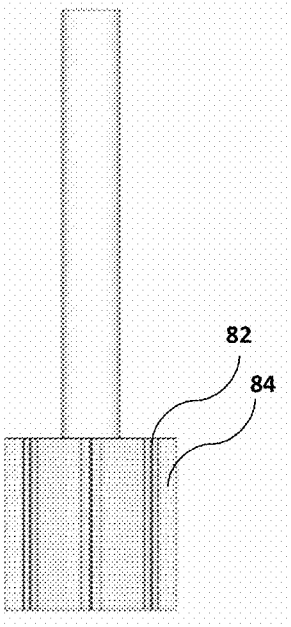
FIGS. 20A-20C show an example a cartridge with eight vertical fins (uniform dimension) on the cartridge (20A) schematic (20B) top-view schematic (20C) side-view schematic.
Figure 20B:
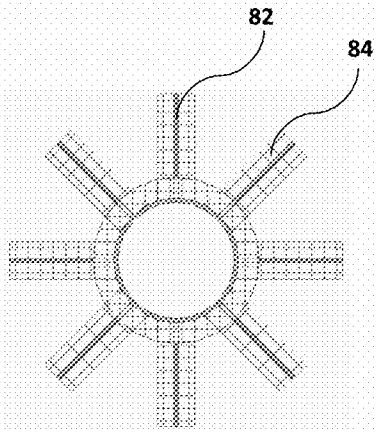
Figure 20A:
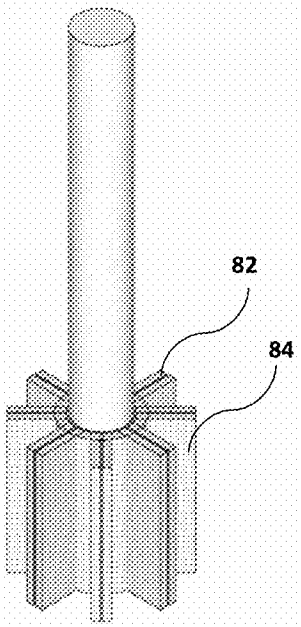
Figure 21C:
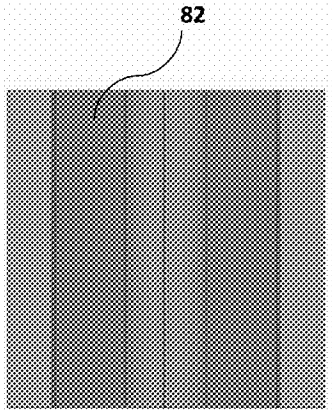
FIGS. 21A-21C show an example of the rigid part of the cartridge of FIGS. 20A-20C. The rigid part of the cartridge has same structure (shape and alignment) as that of the polymer part of cartridge. (21A) schematic (21B) top-view schematic (21C) side-view schematic
Figure 21B:
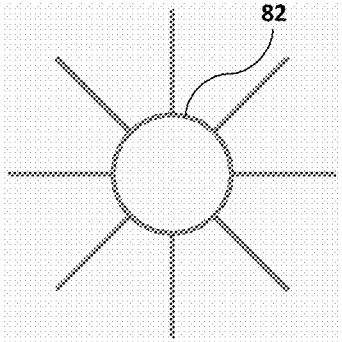
Figure 21A:
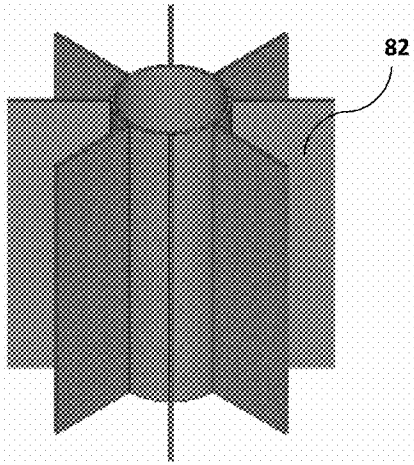
Figure 22C:
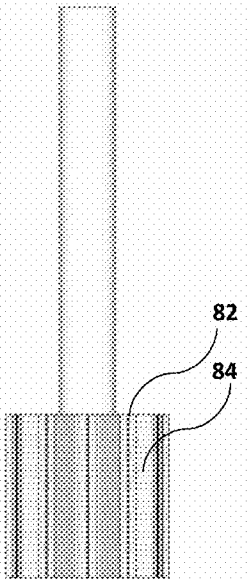
FIGS. 22A-22C show an of a cartridge with twelve vertical fins (uniform dimension). (22A) schematic (22B) top-view schematic (22C) side-view schematic
Figure 22B:
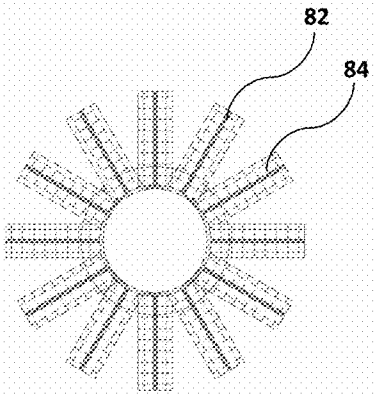
Figure 22A:
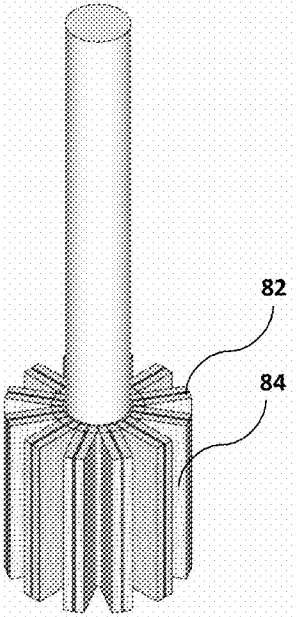
Figures 23A, 23B, 23C:
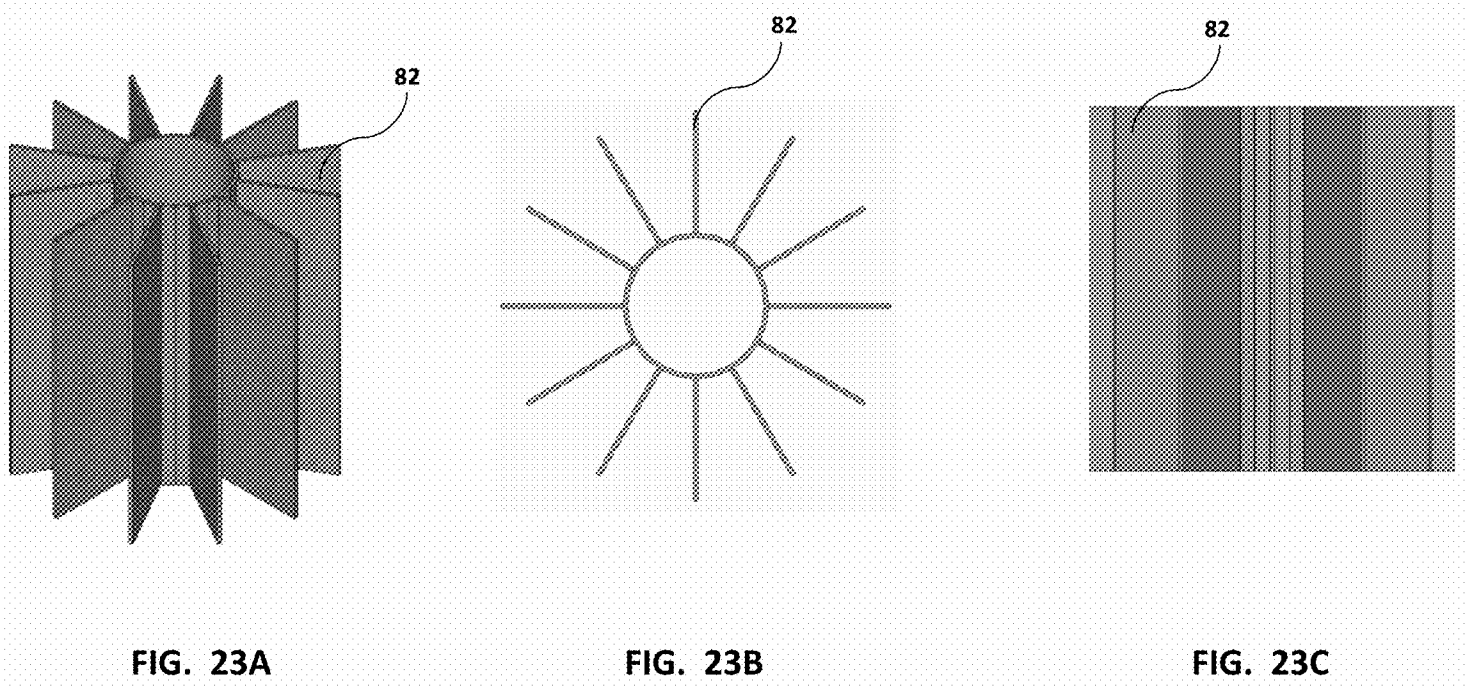
FIGS. 23A-23C show an example of the rigid part of the cartridge of FIGS. 22A-22C The rigid part of the cartridge has same structure (shape and alignment) as that of the polymer part of cartridge. (23A) schematic (23B) top-view schematic (23C) side-view schematic.
Figure 24C:
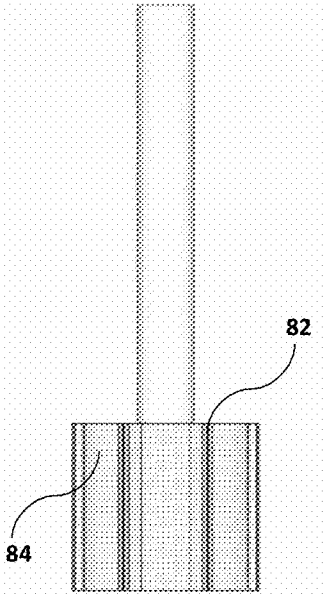
FIGS. 24A-24C show an example of a cartridge with eight dual-vertical fins. (24A) schematic (24B) top-view schematic (24C) side-view schematic.
Figure 24B:
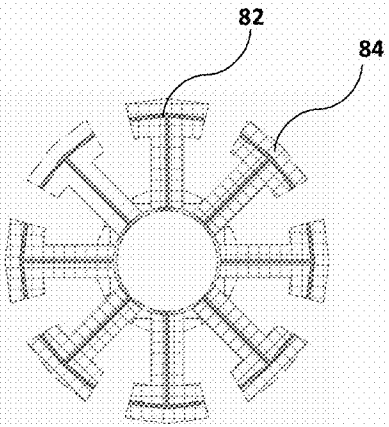
Figure 24A:
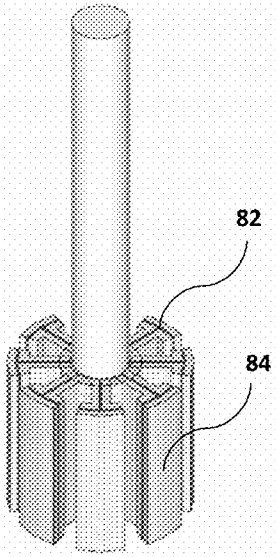
Figure 25C:
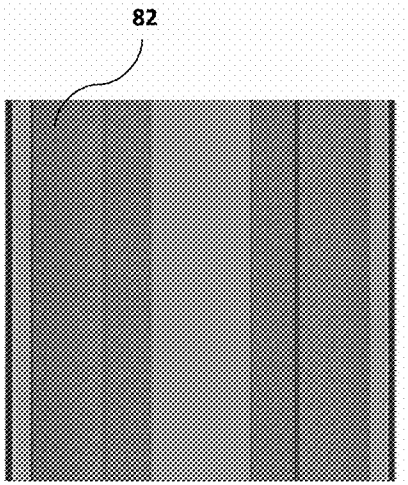
FIGS. 25A-25C show an example of the rigid part of the cartridge of FIGS. 24A-24C. The rigid part of the cartridge has same structure (shape and alignment) as that of the polymer part of cartridge. (25A) schematic (25B) top-view schematic (25C) side-view schematic
Figure 25B:
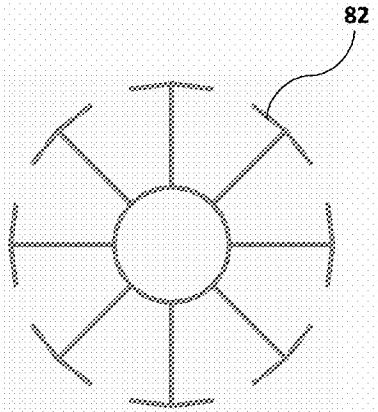
Figure 25A:
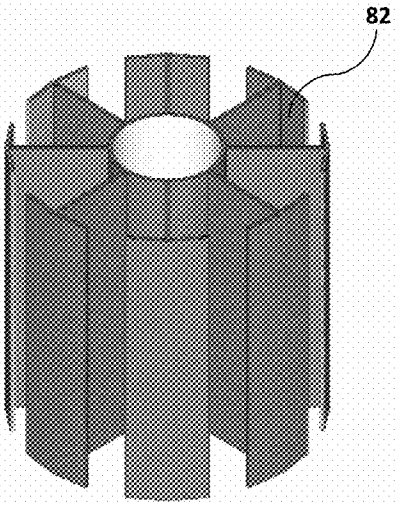

FIGS. 7A-7D schematically depicts a manner in which the resilient elastic sheath 84 may be non-conformal with rigid core 82. As seen in FIG. 7D the sheath 84 may be added in an arbitrary shape to create an overall desired profile on the flange. In this manner, numerous shapes may be configured over the rigid core and customized to the final bollard system application.

FIGS. 9A-9C, 11A-11C, 13A-13C, 15A-15C, 17A-17C, 19A-19C, 20A-20C, 22A-22C, and 24A-24C depict various cartridge configurations showing resilient elastic sheaths 84 covering core portions 82. FIGS. 10A-10B, 12A-12C, 14A-14C, 16A-16B, 18A-18B, 21A-21C, 23A-23C, and 25A-25C depict in detail the rigid core portions 82 of the composite energy-absorbing deformable cartridges 20 depicted in the preceding FIGS. Note that these configurations are mostly conformal sheath embodiments; however, all of the rigid cores may be covered with non-conformal sheaths in varying configurations depending upon the final application of the bollard system.

In another aspect, the rigid core portions 82 of cartridge 20 may include one or more voids 86 that act as crumple zones for dissipating impact energy. These voids are created using one or more straight or curved separating walls 87. By filling these voids with the elastic resilient sheath material 84, considerable additional impact energy may be dissipated.

The composite energy-absorbing deformable cartridge 20 surrounding the distal portion of stanchion 10 is embedded withing retaining foundation 40. The retaining foundation may be made from cement, gravel, and other bonding materials. A total depth of the foundation underground is from 200 to 800 mm, at a width/diameter of 300 to 2500 mm. Optionally, a frame 30 is provided within the foundation to protect the stanchion and to strengthen the retaining foundation. The frame can be made of metals, alloys, or composite materials of metal and other non-metallic materials.

When the stanchion is hit, elastic deformation will occur, followed by plastic deformation (such as buckling). The kinetic energy of the vehicle is first transferred to the stanchion 10 and then transferred to the cartridge 20. The bollard system absorbs energy during impact events by multiple stages of deformation and fracture processes of each bollard system component. The retaining foundation 40 absorbs energy during stanchion collapse and cartridge deformation.

EXAMPLE 1

Bollard System Cartridge

As discussed above, various bollard system cartridge configurations 20 may be selected including horizontally-extending flanges or vertically-extending fins, as depicted in FIGS. 3B-3J. These structures increase the contact area of the cartridge which permits the overall bollard system 100 to minimize the cartridge depth as compared to the overall height of the bollard system. As stated above, a low-profile cartridge portion is required in dense urban areas due to underground structures such as pipes, cables, and optical fibers.

Several structures with increased contact area along the bollard system axial direction were investigated, as shown in FIGS. 3 and 4. Compared to prior art design of FIG. 3A, an existing product in the market requiring an installation depth of 1000 mm within a retaining foundation and a surface area underground of 0.64 $m^2$, the configurations of FIGS. 3B-3J require only a shallow depth of 500 mm with potential similar or better protection performances.

As seen in FIG. 4, the configurations of FIGS. 3B-3J all show larger surface areas underground, than the prior art design of FIG. 3A.

Figure 30:
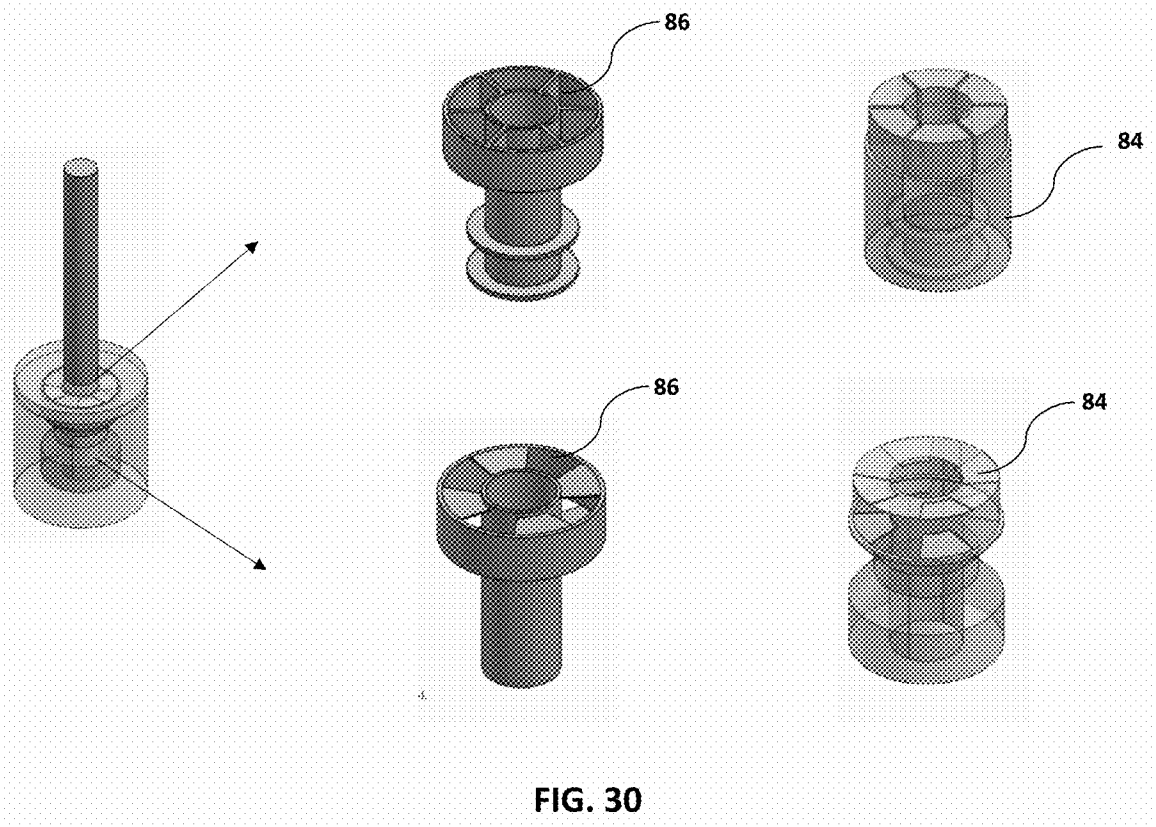
FIG. 30 shows an example of an impact dissipating bollard system.

FIGS. 29A-29E depict an exemplary bollard system. The bollard system 100 includes stanchion 10, cartridge 20, frame 30, and foundation 40. FIGS. 29B-29D show a rigid core portion 82 that includes flanges 21 with rigid energy-absorbing portions. The energy-absorbing portions includes voids 86 (FIG. 29C) that form crumple zones that deform to absorb the energy of an impact. The energy-absorbing structure include several fins 87 welded within the flange 21. Fins 21 may have a curved shape and extend in a direction normal to the flange. The foundation 40 in FIG. 29E is concrete with a frame 40 that is fabricated from at least 6 mm diameter steel rebar in both horizontal and vertical directions. The average compressive strength of the concrete in the foundation at the time of testing is at least 30 MPa. FIG. 30 depicts further examples for crumple zone 86 configurations that may be used in bollard system 100 with straight partitions forming the crumple zones and horizontally-extending partitions forming the crumple zones 86.

EXAMPLE 2

Testing of the Bollard System

Several embodiments of the bollard system are tested is to compare their properties under stress, with the relationship simulation among behavior, stress, and energy distribution. Mechanical property analysis of three designs of FIG. 3A (prior art), FIG. 3B, and FIG. 3C were conducted using a finite element analysis (FEA) software, whose results are shown in FIG. 4. The cartridges of the present invention with fins and flanges are able to withstand higher stress. The additional side structures of the impact-dissipating bollard system reduce the stress and more uniformly distribute energy despite extending into the retaining foundation at a shallower depth.

Vehicle impact simulation was performed to evaluate the bollard system including crumple zones depicted in FIG. 29. The system is configured to stop an N2 type 7,500 kg 2-axle vehicle impacting the bollard system at 48 km/hr at an impact angle of 90 degrees to the front face of the bollard system according to the requirements of PAS 68:2013. During and after the impact, no element of the bollard system shall penetrate beyond "A" pillar/leading edge of the vehicle load platform as defined in PAS 68:2013. The vehicle shall also not roll over (including rollover of the vehicle onto its side) during or after impact.

Figure 33:
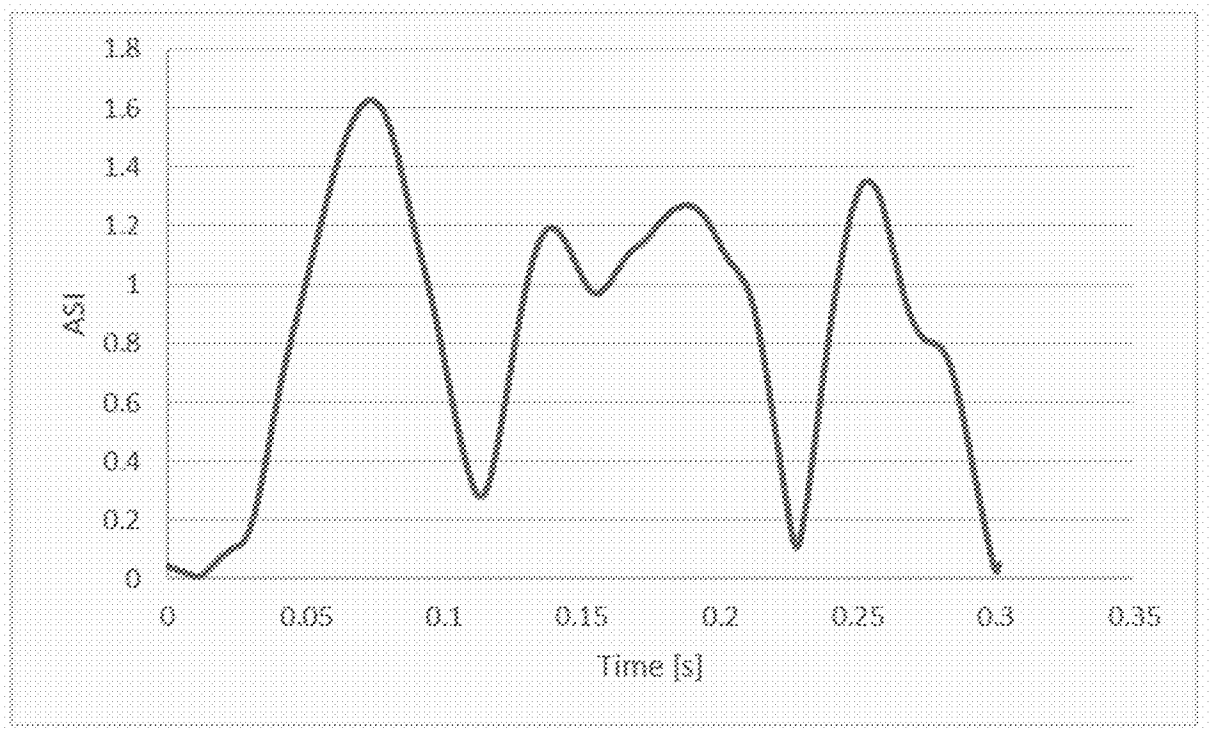
FIG. 33 shows the plot of ASI versus time for a bollard system validation.

The vehicle was stopped eventually with a penetration distance of 516 mm. The penetration distance of vehicle versus time is shown in FIG. 31. Images of the bollard system after impact are shown in FIGS. 32A-32G. The cartridge and top concrete layer both sustained damage. The final angle of inclination of the stanchion was 45.36 degrees. The impact severity level is used to assess the effects of collision on passengers inside the vehicle based on two indicators: the acceleration severity index (ASI) and the theoretical head impact velocity (THIV). Impact severity level A ($ASI \leq 1.0$) provides a greater level of safety for vehicle occupants than impact severity level B ($1.0 < ASI \leq 1.4$), and level B provides a greater level of safety than level C ($1.4 < ASI \leq 1.9$). There are no acceptance criteria of ASI and THIV for this simulation in accordance with PAS 68 and BS EN 1317. The ASI and THIV over time were calculated. The maximum ASI value in the collision was 1.63. The THIV value was 29 km/h. The plots of ASI versus time are shown in FIG. 33.

EXAMPLE 3

Polyurethane Sheath for Bollard System Cartridge

The cartridge sheath 84 of the bollard system 100 is made from materials that provide energy absorption and protection. Sheath 84 surrounds stanchion 10 and absorbs the kinetic energy of a vehicle as a buffer through its deformation when the vehicle crashes into the bollard. This deformation reduces the damage to the vehicle and its occupants.

As an example of cartridge sheath using a polymer foam, viscoelastic polyurethane has a larger energy-absorption capability compared to other elastic foams. The viscoelastic properties are derived from the phase separation of the hard and soft copolymer segments of the polymer, which inhibit the plastic flow of the polymer chains. The hard segments, which are formed from the isocyanate and chain extenders, are stiff and immobile, while the soft segments, which are formed from high molecular weight polyols, are mobile and normally present in coiled formation. Thus, the viscoelastic properties of the polyurethane foam may be easily regulated by adjusting the use of isocyanate, chain extender and polyol as well as other additives such as catalyst.

Isocyanates may be chosen from several commercialized isocyanates such as methylene diphenyl diisocyanate (MDI) isomer(s), toluene diisocyanate (TDI) isomer(s), hexamethylene diisocyanate (HDI) or isophorone diisocyanate (IPDI), or a combination of these isocyanates. Prepolymers with different rigid and mobile chains may also be used. Chain extenders that are short chain polyols or polyamines can be bifunctional such as ethylene glycol, 1,4-butanediol, ethanolamine, hydrazine and ethylenediamine, etc., trifunctional such as glycerol, triethanolamine, etc., or multi-functional such as pentaerythritol, sorbitol and sucrose. Long-chain polyols can be bi- or multi-functional polyether polyols or polyester polyols. Other special polyols with a variety of internal repeating unit, such as polybutadiene polyols, polysulfide polyols, polysiloxane polyols, etc. may also be used. Moreover, polyamines may be used as additional long-chain polymer, e.g., polyether polyamines, polyester polyamines, polybutadiene polyamines, polysulfide polyamines, polysiloxane polyamines, etc. These may be used separately or as a mixture. Long-chain monol or monoamine may also be added to adjust the viscoelastic properties of the resulted foam.

Catalysts may be used to accelerate the reaction and may be organic and/or inorganic catalysts. Organic catalysts may be amines such as 1,4-diazabicyclo[2.2.2]octane (DABCO), N,N,N',N'-tetramethyl-1,4-butanediamine (TMBDA), triethylamine, N-ethyl morpholine, etc. Inorganic catalysts may be metal carboxylates such as stannous oactoate, dibutyltin dilaurate, etc.

Other additives with non-Newtonian properties may be used to increase the energy absorption and so protection performance, including shear-thickening fluids or dilatants. The shear-thickening fluids may be hydroxyl terminated dialkylsiloxane polymer and borate cross-linked hydroxyl terminated dialkylsiloxane polymer, and exemplary dilatants be polyborondimethylsiloxanes (PBDMS) and any silicone containing borated polydimethylsiloxane (PDMS). In certain embodiments, the dilatant is polyborondimethylsiloxanes (PBDMS) prepared from 2,000 to 4,000 or 2,000 to 3,500 Dalton hydroxyl terminated dimethylsiloxane polymer.

Related polyurethane foams may be further processed into an auxetic foam structure with negative Poisson's ratio, which expands when stretched and hardens when compressed, providing the foams with a greater energy absorption capacity. The polyurethane foams may be compressed uniaxially, biaxially, or triaxially in a mold under proper pressure and temperature, and then cooled down to form the desired auxetic foam. Moreover, this process can be facilitated by using compressed gas such as $CO_2$ or water vapor.

EXAMPLE 4

Stanchion Filler Material Effect on Bollard Strength

Figure 34:
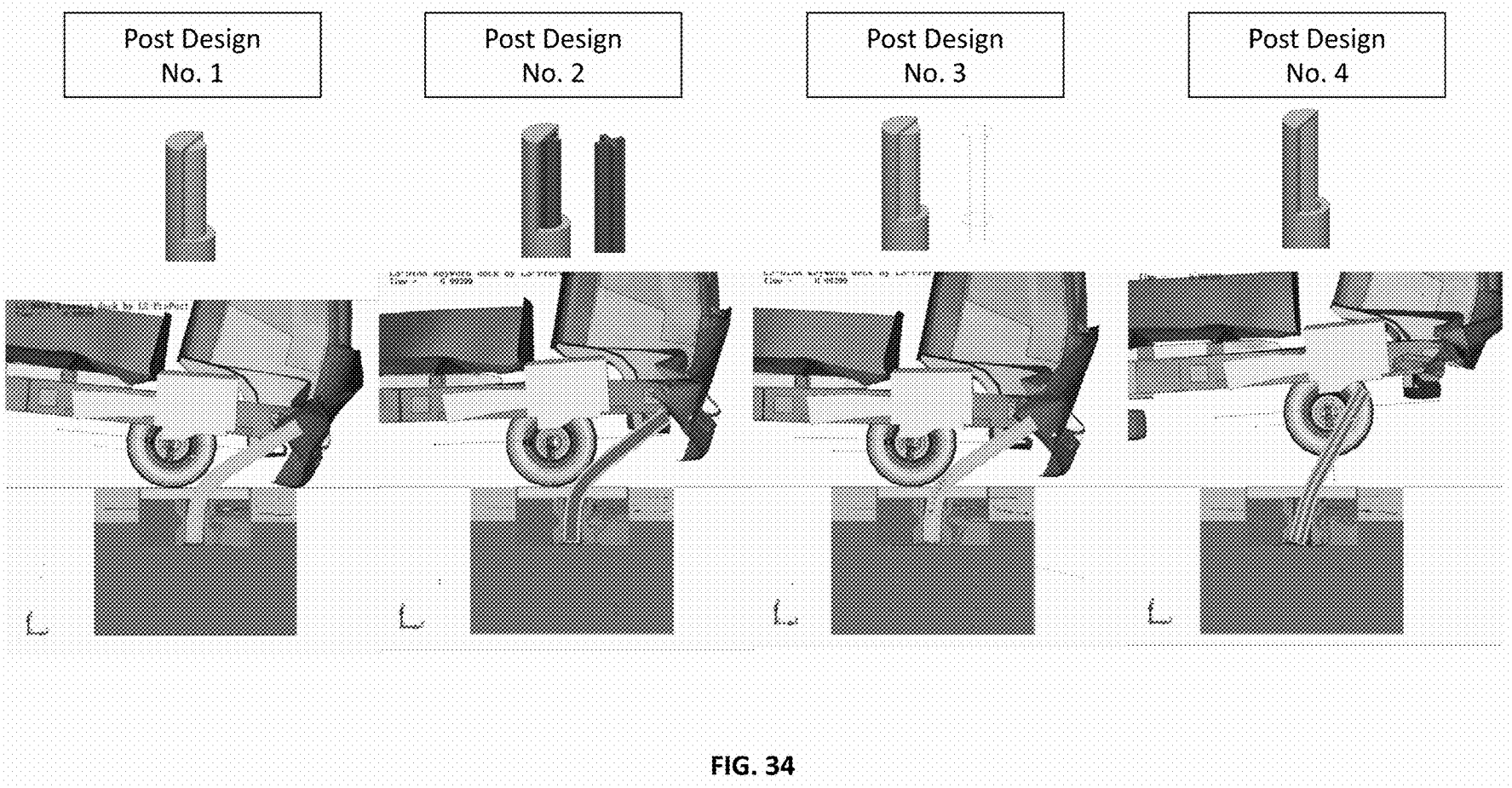
FIG. 34 shows effects of a stanchion filler material.

In FIG. 34, different filler materials were tested, the results of which are summarized in Table 1, below.

TABLE 1

Filler Material Effects:

| Post Design No. | Post material | Filler material & Shape | Vehicle stop? Yes/No | IDB absorbed energy % | Penetration mm | Inclination degree |
|---|---|---|---|---|---|---|
| 1 | SS304 | PU/Cylinder | Yes | 61.0% | −628 | 59.5 |
| 2 | SS304 | SS304/Cross | Yes | 58.6% | −698 | 53.0 |
| 3 | SS304 | C40/Cylinder | Yes | 59.0% | −658 | 57.4 |
| 4 | SS2205 | N/A | Yes | 42.3% | −268 | 28.2 |

As shown in Table 1, when the posts are filled with PU, SS304 and concrete, the inclination degree of the post after impact are 59.5, 53.0 and 57.4, respectively. The energy absorption of IBD can reach to the highest value of 61% when the post is filled with PU. It is also noted that all the design of post can stop the 7.5 ton truck at the speed of 48 km/h.

EXAMPLE 5

Stanchion Length Effect on Bollard Strength

Figure 35:
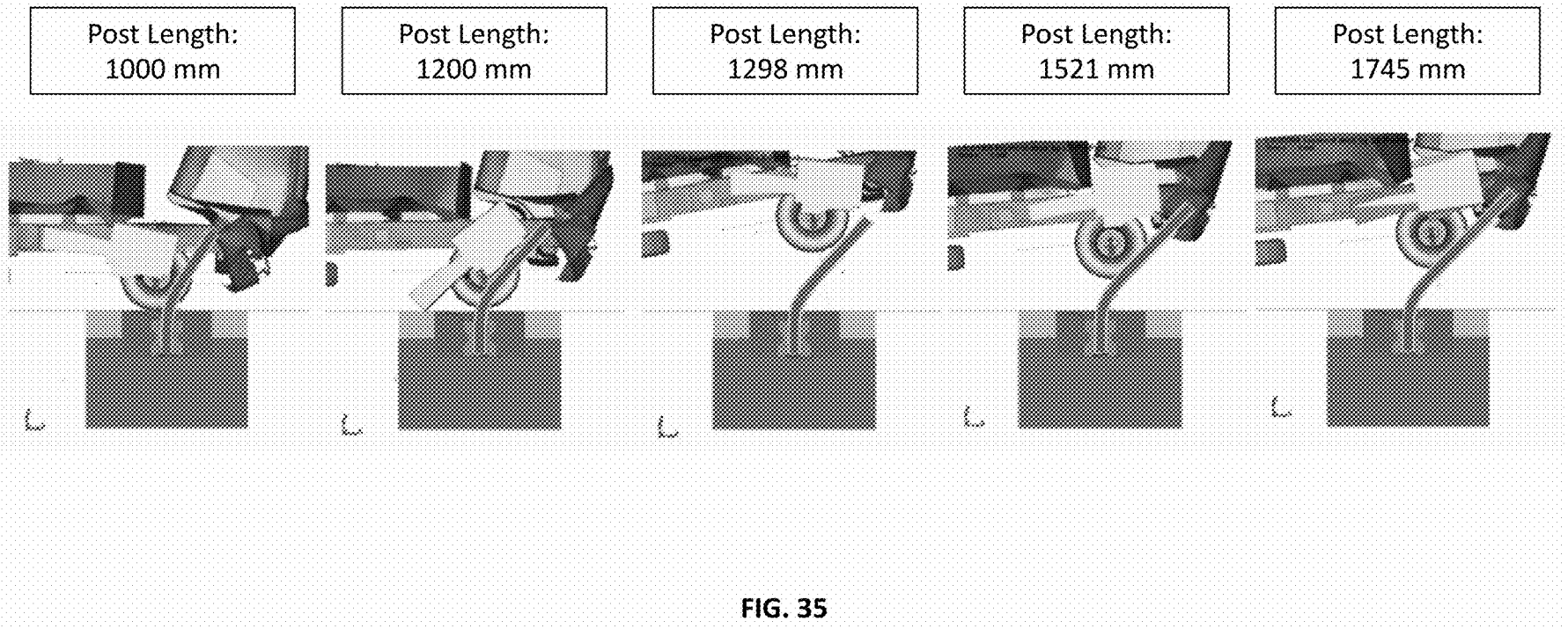
FIG. 35 shows the effects of stanchion length.

FIG. 35 shows the testing of different station lengths, the results of which are summarized in Table 2, below:

TABLE 2

Stanchion Length Effects:

| Post Length mm | Vehicle stop? Yes/No | IDB absorbed energy % | Penetration mm | Inclination degree |
|---|---|---|---|---|
| 1000 | Yes | 33.7% | −582 | 32.8 |
| 1200 | Yes | 38.5% | −438 | 40.7 |
| 1298 | Yes | 34.1% | −364 | 41.7 |
| 1521 | Yes | 33.8% | −412 | 43.6 |
| 1745 | Yes | 33.8% | −275 | 44.2 |

Bollards with different post lengths were tested and yet the IDB still able to stop the truck @ 48 kmh. It is also found that when the length of post increases, the inclination degree will become larger. However, the bollard with post of 1200 mm length has higher energy absorption performance than others.

EXAMPLE 6

Cartridge Crumple Zone Design Effects

FIG. 36 shows the testing of different cartridge crumple zone designs, the results of which are summarized in Table 3, below:

TABLE 3

| Crumple Zone Design Effects: | | | | | |
|---|---|---|---|---|---|
| Cartridge Design No. | Cartridge Design Drawing | Vehicle stop? Yes/No | IDB absorbed energy % | Penetration mm | Inclination degree |
| 1 | 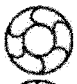 | Yes | 52.9% | −708 | 43 |
| 2 | 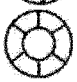 | Yes | 54.2% | −1888 | 52 |
| 3 | 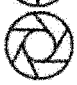 | Yes | 52.6% | −1308 | 42 |
| 4 | 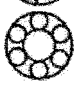 | Yes | 61.8% | −1748 | 45 |
| 5 | 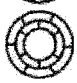 | Yes | 53.3% | −1933 | 51 |

Bollards with different cartridge designs were tested and yet the IDB still able to stop the truck @ 48 kmh. For design 2, the inclination degree of post is larger than others. However, bollard with cartridge of design 4 has the highest energy absorption performance of 61.8%.

EXAMPLE 7

Foam Effects

Figure 37:
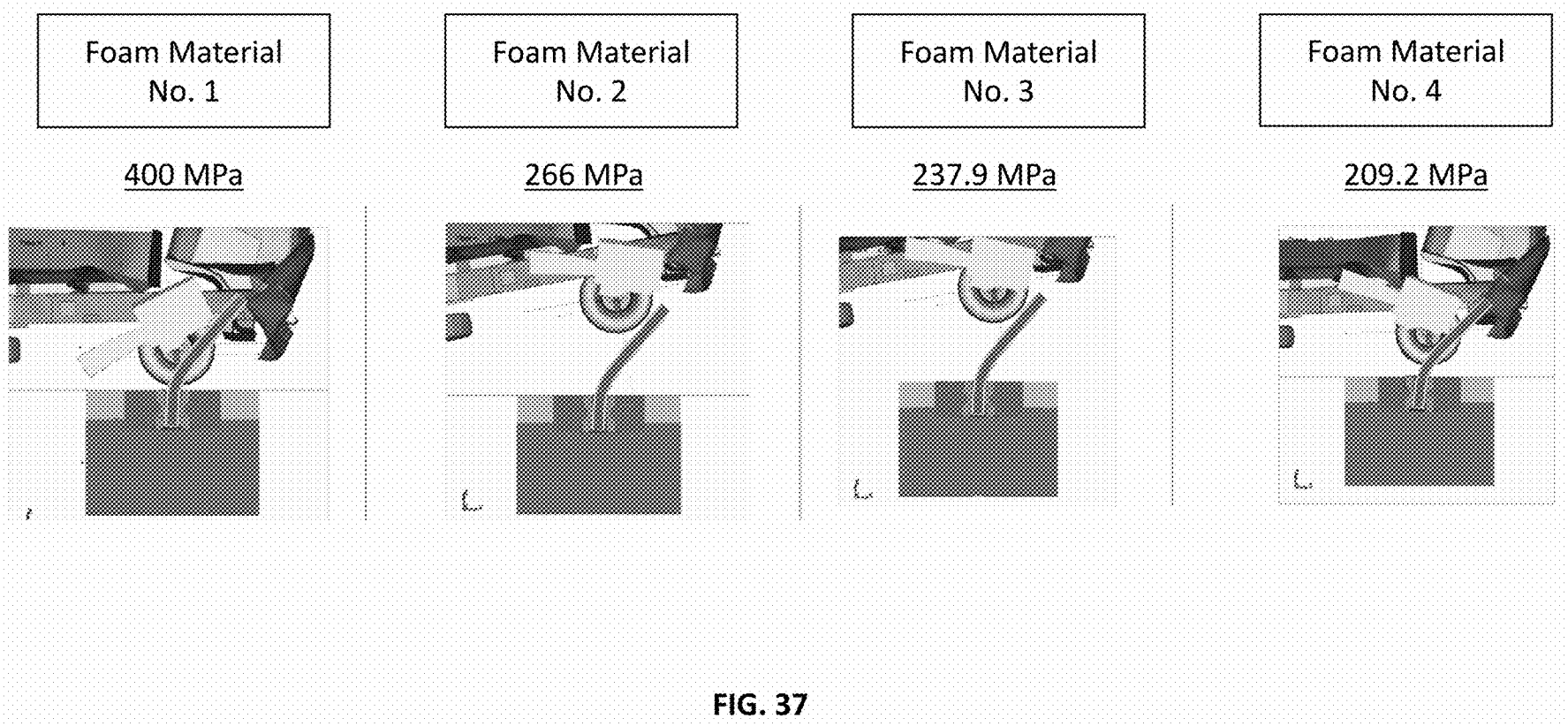
FIG. 37 shows the effects of the foam.

FIG. 37 shows the testing of different foams, the results of which are summarized in Table 4, below:

TABLE 4

| Foam Effects: | | | | | |
|---|---|---|---|---|---|
| Foam material No. | Young's modulus MPa | Vehicle stop? Yes/No | IDB absorbed energy % | Penetration mm | Inclination degree |
| 1 | 400 | Yes | 38.5% | −443 | 39.9 |
| 2 | 266 | Yes | 37.8% | −389 | 40.1 |
| 3 | 237.9 | Yes | 37.9% | −407 | 39.8 |
| 4 | 209.2 | Yes | 37.9% | −406 | 39.5 |

Bollards with different foam material were tested and yet the IDB still able to stop the truck @ 48 kmh. It is found that the IDB's energy absorption performance is around 38% when the foam has Young's modulus of 200-400 MPa.

EXAMPLE 8

Concrete Base Strength Effects

Figure 38:
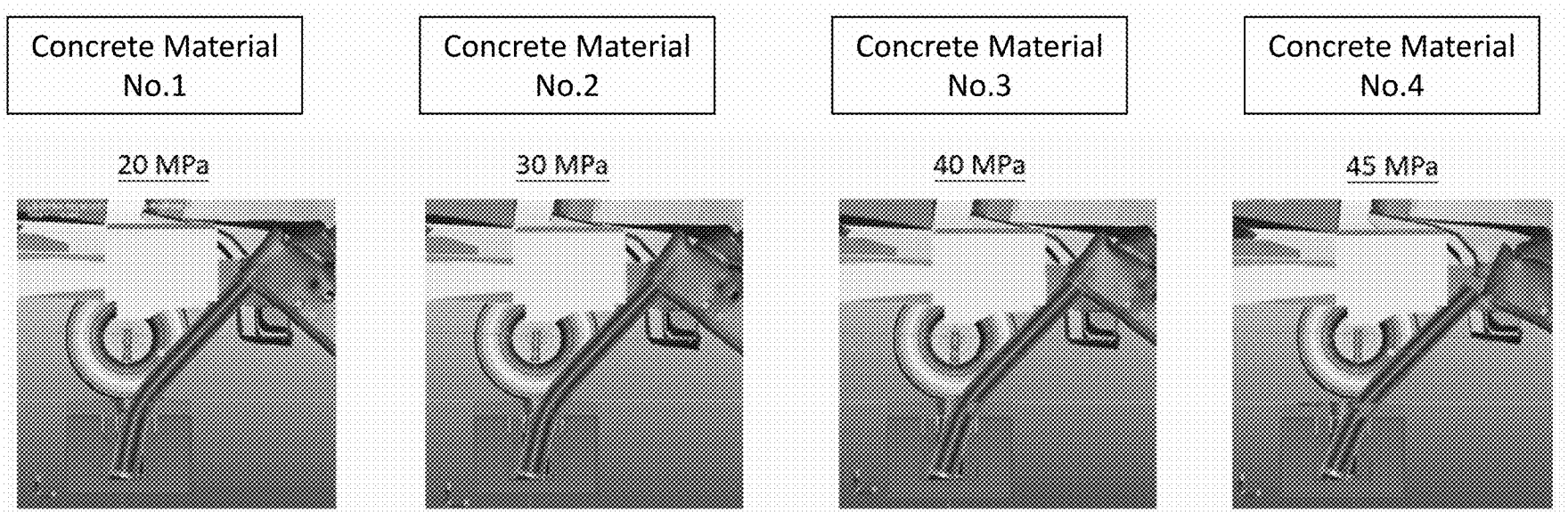
FIG. 38 shows the effects of the concrete base.

FIG. 38 shows the testing of different concrete base strengths, the results of which are summarized in Table 5, below:

TABLE 5

| Concrete Base Strength Effects: | | | | | |
|---|---|---|---|---|---|
| Concrete Material No. | Strength MPa | Vehicle stop? Yes/No | IDB absorbed energy % | Penetration mm | Inclination degree |
| 1 | 20 | Yes | 53% | −1056 | 35 |
| 2 | 30 | Yes | 52% | −806 | 37 |

TABLE 5-continued

| Concrete Base Strength Effects: | | | | | |
|---|---|---|---|---|---|
| Concrete Material No. | Strength MPa | Vehicle stop? Yes/No | IDB absorbed energy % | Penetration mm | Inclination degree |
| 3 | 40 | Yes | 52% | −411 | 38 |
| 4 | 45 | Yes | 52% | <0 | 37 |

Bollards with concrete strength of 20-45 MPa has been tested. The IDB can stop the truck in all of these cases.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit, and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

As used herein, terms "approximately", "basically", "substantially", and "about" are used for describing and explaining a small variation. When being used in combination with an event or circumstance, the term may refer to a case in which the event or circumstance occurs precisely, and a case in which the event or circumstance occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all the ranges disclosed in the present disclosure include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

The invention claimed is:

1. An impact-dissipating bollard system comprising:

a vertical stanchion having a first portion extending above a retaining foundation and a second portion extending beneath a retaining foundation;

a composite energy-absorbing dumbbell-shaped deformable cartridge configured to be positioned within the retaining foundation, the composite energy-absorbing dumbbell-shaped deformable cartridge including:

a rigid core portion including a stanchion-receiving aperture;

first and second projections extending from the rigid core portion, the first and second projections, together with the core portion, forming the dumbbell shape;

energy-absorbing resilient elastic material surrounding the rigid core portion and positioned within recesses within the first and second projections;

wherein the bollard system is configured such that impact energy is transferred from the vertical stanchion to deform the composite energy-absorbing deformable cartridge; and wherein the retaining foundation includes a reinforcing frame embedded in concrete and having a strength of least 30 MPa.

2. The impact-dissipating bollard system of claim 1, wherein the energy-absorbing resilient elastic material comprises foam.

3. The impact-dissipating bollard system of claim 1, wherein the vertical stanchion comprises a hollow, reinforced structure.

4. The impact-dissipating bollard system of claim 3, wherein the hollow, reinforced structure includes a network of interconnected supports.

5. The impact-dissipating bollard system of claim 4, wherein the interconnected supports are interconnected hollow polygons or cylinders.

6. The impact-dissipating bollard system of claim 5, wherein the interconnected supports are interconnected polygons selected from triangles, squares, rectangles, pentagons, or hexagons.

7. The impact-dissipating bollard system of claim 3, wherein the hollow, reinforced structure includes a filler material.

8. The impact-dissipating bollard system of claim 7, wherein the filler material is selected from polymers, foams, shear-thickening fluids, or particulates.

9. The impact-dissipating bollard system of claim 3, wherein the vertical stanchion comprises metal, plastic, rubber, or fiber-reinforced composites.

10. The impact-dissipating bollard system of claim 1, wherein the rigid core portion of the composite energy-absorbing deformable cartridge comprises metal, polymer, fiber-reinforced composites, or ceramic.

11. The impact-dissipating bollard system of claim 2, wherein the foam is selected from metal foam, honeycomb metal, ethylene vinyl acetate foam, polyethylene terephthalate foam, polyvinyl chloride foam, polystyrene foam, or polyurethane foam.

12. The impact-dissipating bollard system of claim 2, wherein the foam includes a shear-thickening fluid.

13. The impact-dissipating bollard system of claim 12, wherein the shear-thickening fluid includes a hydroxyl terminated dialkylsiloxane polymer or a borate cross-linked hydroxyl terminated dialkylsiloxane polymer.

14. The impact-dissipating bollard system of claim 1, wherein the projections have an approximately circular cross-section.

15. The impact-dissipating bollard system of claim 14, wherein the projections include deformable crumple zones.

16. The impact-dissipating bollard system of claim 15, wherein the deformable crumple zones include separating walls within the projection to create internal voids for dissipating impact energy.

17. The impact-dissipating bollard system of claim 11, wherein the foam has an auxetic foam structure with a negative Poisson's ratio, such that the foam expands when stretched and hardens when compressed.

* * * * *